US009554203B1

(12) United States Patent
Pavlidi et al.

(10) Patent No.: US 9,554,203 B1
(45) Date of Patent: Jan. 24, 2017

(54) SOUND SOURCE CHARACTERIZATION APPARATUSES, METHODS AND SYSTEMS

(71) Applicants: Despoina Pavlidi, Heraklion (GR); Anthony Griffin, Herklion (GR); Athanasios Mouchtaris, Filothei (GR)

(72) Inventors: Despoina Pavlidi, Heraklion (GR); Anthony Griffin, Herklion (GR); Athanasios Mouchtaris, Filothei (GR)

(73) Assignee: Foundation for Research and Technolgy—Hellas (FORTH) Institute of Computer Science (ICS), Heraklion (GR)

( * ) Notice: Subject to any disclaimer, the term of this patent is extended or adjusted under 35 U.S.C. 154(b) by 112 days.

(21) Appl. No.: 14/038,726

(22) Filed: Sep. 26, 2013

Related U.S. Application Data

(60) Provisional application No. 61/706,073, filed on Sep. 26, 2012.

(51) Int. Cl.
*H04R 3/00* (2006.01)
*H04R 1/08* (2006.01)
*H04R 1/40* (2006.01)

(52) U.S. Cl.
CPC ..... *H04R 1/08* (2013.01); *H04R 1/406* (2013.01); *H04R 3/005* (2013.01)

(58) Field of Classification Search
CPC ..... H04R 1/08; H04R 3/005; H04R 1/406
USPC ..... 381/91–92, 122
See application file for complete search history.

(56) References Cited

U.S. PATENT DOCUMENTS

| | | | | |
|---|---|---|---|---|
| 7,555,161 | B2 * | 6/2009 | Haddon et al. | 382/173 |
| 2008/0089531 | A1 * | 4/2008 | Koga et al. | 381/92 |
| 2009/0080666 | A1 | 3/2009 | Uhle et al. | |
| 2010/0135511 | A1 | 6/2010 | Pontoppidan | |
| 2010/0142327 | A1 * | 6/2010 | Kepesi | G01S 3/786 367/124 |
| 2010/0217590 | A1 | 8/2010 | Nemer et al. | |
| 2010/0278357 | A1 | 11/2010 | Hiroe | |
| 2011/0091055 | A1 | 4/2011 | LeBlanc | |
| 2011/0110531 | A1 | 5/2011 | Klefenz et al. | |
| 2012/0020485 | A1 | 1/2012 | Visser et al. | |

(Continued)

OTHER PUBLICATIONS

B. Loesch et al., "Multidimensional localization of multiple sound sources using frequency domain ICA and an extended state coherence transform," IEEE/SP 15th Workshop Statistical Signal Processing (SSP), pp. 677-680, Sep. 2009.

(Continued)

*Primary Examiner* — Disler Paul
(74) *Attorney, Agent, or Firm* — Chadbourne & Parke LLP

(57) ABSTRACT

A processor-implemented method for sound characterization is described. In one implementation, time-frequency transform of each of a plurality of sound signals from one or more sources, the sound signals being detected by a plurality of sensing devices, is derived. One or more single-source constant-time analysis zones based at least on correlation between the time-frequency transform signals from a pair of sensing devices are detected. At least one direction of arrival for each source in the detected single source analysis zones are detected. A histogram of the estimated directions of arrival is created and an estimate of a number of the sound sources and corresponding directions of arrival are generated based at least on the histogram.

21 Claims, 10 Drawing Sheets

(56) References Cited

U.S. PATENT DOCUMENTS

| | | | | |
|---|---|---|---|---|
| 2012/0114126 | A1 | 5/2012 | Thiergart et al. | |
| 2012/0140947 | A1* | 6/2012 | Shin | H04R 3/005 381/92 |
| 2012/0221131 | A1* | 8/2012 | Wang et al. | 700/94 |
| 2013/0108066 | A1* | 5/2013 | Hyun | H04R 3/005 381/59 |
| 2013/0216047 | A1 | 8/2013 | Kuech et al. | |
| 2013/0259243 | A1 | 10/2013 | Herre et al. | |
| 2013/0268280 | A1 | 10/2013 | Del Galdo et al. | |
| 2013/0272548 | A1* | 10/2013 | Visser | G06K 9/00624 381/122 |
| 2013/0287225 | A1 | 10/2013 | Niwa et al. | |
| 2014/0172435 | A1 | 6/2014 | Thiergart et al. | |
| 2014/0376728 | A1 | 12/2014 | Rämö et al. | |
| 2015/0310857 | A1 | 10/2015 | Habets et al. | |

OTHER PUBLICATIONS

A. Lombard et al., "TDOA estimation for multiple sound sources in noisy and reverberant environments using broadband independent component analysis," IEEE Transactions on Audio, Speech, and Language Processing, pp. 1490-1503, vol. 19, No. 6, Aug. 2011.

H. Sawada et al., "Multiple source localization using independent component analysis," IEEE Antennas and Propagation Society International Symposium, pp. 81-84, vol. 4B, Jul. 2005.

F. Nesta and M. Omologo, "Generalized state coherence transform for multidimensional TDOA estimation of multiple sources," IEEE Transactions on Audio, Speech and Language Processing, pp. 246-260, vol. 20, No. 1, Jan. 2012.

M. Swartling et al., "Source localization for multiple speech sources using low complexity non-parametric source separation and clustering," in Signal Processing, pp. 1781-1788, vol. 91, Issue 8, Aug. 2011.

C. Blandin et al., "Multi-source TDOA estimation in reverberant audio using angular spectra and clustering," in Signal Processing, vol. 92, No. 8, pp. 1950-1960, Aug. 2012.

D. Pavlidi et al., "Real-time multiple sound source localization using a circular microphone array based on single-source confidence measures," in International Conference on Acoustics, Speech and Signal Processing (ICASSP), pp. 2625-2628, Mar. 2012.

O. Yilmaz and S. Rickard, "Blind separation of speech mixtures via time-frequency masking," IEEE Transactions on Audio, Speech, and Language Processings, pp. 1830-1847, vol. 52, No. 7, Jul. 2004.

E. Fishler et al., "Detection of signals by information theoretic criteria: General asymptotic performance analysis," in IEEE Transactions on Signal Processing, pp. 1027-1036, vol. 50, No. 5, May 2002.

M. Puigt and Y. Deville, "A new time-frequency correlation-based source separation method for attenuated and time shifted mixtures," in 8th International Workshop on Electronics, Control, Modelling, Measurement and Signals 2007 and Doctoral School (EDSYS,GEET), pp. 34-39, May 28-30, 2007.

G. Hamerly and C. Elkan, "Learning the *k* in *k*-means," in Neural Information Processing Systems, Cambridge, MA, USA: MIT Press, pp. 281-288, 2003.

B. Loesch and B. Yang, "Source number estimation and clustering for underdetermined blind source separation," in Proceedings International Workshop Acoustic Echo Noise Control (IWAENC), 2008.

S. Araki et al., "Stereo source separation and source counting with MAP estimation with dirichlet prior considering spatial aliasing problem," in Independent Component Analysis and Signal Separation, Lecture Notes in Computer Science. Berlin/Heidelberg, Germany: Springer , vol. 5441, pp. 742-750, 2009.

A. Karbasi and A. Sugiyama, "A new DOA estimation method using a circular microphone array," in Proceedings European Signal Processing Conference (EUSIPCO), 2007, pp. 778-782.

S. Mallat and Z. Zhang, "Matching pursuit with time-frequency dictionaries," IEEE Transactions on Signal Processing, vol. 41, No. 12, pp. 3397-3415, Dec. 1993.

D. Pavlidi et al., "Source counting in real-time sound source localization using a circular microphone array," in Proc. IEEE 7th Sensor Array Multichannel Signal Process. Workshop (SAM), Jun. 2012, pp. 521-524.

A. Griffin et al., "Real-time multiple speaker DOA estimation in a circular microphone array based on matching pursuit," in Proceedings 20th European Signal Processing Conference (EUSIPCO), Aug. 2012, pp. 2303-2307.

P. Comon and C. Jutten, Handbook of Blind Source Serparation: Independent Component Analysis and Applications, ser. Academic Press. Burlington, MA: Elsevier, 2010.

M. Cobos et al., "On the use of small microphone arrays for wave field synthesis auralization," *Proceedings of the 45th International Conference: Applications of Time-Frequency Processing in Audio Engineering Society Conference*, Mar. 2012.

H. Hacihabiboglu and Z. Cvetkovic, "Panoramic recording and reproduction of multichannel audio using a circular microphone array," in *Proceedings of the IEEE Workshop on Applications of Signal Processing to Audio and Acoustics* (*WASPAA 2009*), pp. 117-120, Oct. 2009.

K. Niwa A. et al., "Encoding large array signals into a 3D sound field representation for selective listening point audio based on blind source separation," in *Proceedings of the IEEE International Conference on Acoustics, Speech and Signal Processing* (*ICASSP 2008*), pp. 181-184, Apr. 2008.

V. Pulkki, "Spatial sound reproduction with directional audio coding," *Journal of the Audio Engineering Society*, vol. 55, No. 6, pp. 503-516, Jun. 2007.

F. Kuech et al., "Directional audio coding using planar microphone arrays," in Proceedings of the Hands-free Speech Communication and Microphone Arrays (HSCMA), pp. 37-40, May 2008.

O. Thiergart et al., "Parametric spatial sound processing using linear microphone arrays," in *Proceedings of Microelectronic Systems, A. Heuberger, G. Elst, and R.Hanke, Eds.*, pp. 321-329, Springer, Berlin, Germany, 2011.

M. Kallinger et al., "Enhanced direction estimation using microphone arrays for directional audio coding," in *Proceedings of the Hands-free Speech Communication and Microphone Arrays* (*HSCMA*), pp. 45-48, May 2008.

M. Cobos et al., "A sparsity-based approach to 3D binaural sound synthesis using time-frequency array processing," *Eurasip Journal on Advances in Signal Processing*, vol. 2010, Article ID 415840, 2010.

L.M. Kaplan et al., "Bearings-only target localization for an acoustical unattended ground sensor network," *Proceedings of Society of Photo-Optical Instrumentation Engineers* (*SPIE*), vol. 4393, pp. 40-51, 2001.

A. Bishop and P. Pathirana, "Localization of emitters via the intersection of bearing lines: A ghost elimination approach," *IEEE Transactions on Vehicular Technology*, vol. 56, No. 5, pp. 3106-3110, Sep. 2007.

A. Bishop and P. Pathirana, "A discussion on passive location discovery in emitter networks using angle-only measurements," *International Conference on Wireless Communications and Mobile Computing* (*IWCMC*), *ACM*, pp. 1337-1343, Jul. 2006.

J. Reed et al., "Multiple-source localization using line-of-bearing measurements: Approaches to the data association problem," *IEEE Military Communications Conference* (*MILCOM*), pp. 1-7, Nov. 2008.

M. Swartling et al., "Source localization for multiple speech sources using low complexity non-parametric source separation and clustering," *Signal Processing*, vol. 91, Issue 8, pp. 1781-1788, Published Aug. 2011, Available Online Feb. 2011.

A. Alexandridis et al., "Directional coding of audio using a circular microphone array," *IEEE International Conference on Acoustics, Speech and Signal Processing* (*ICASSP*), pp. 296-300, May 2013.

A. Alexandridis et al., "Capturing and Reproducing Spatial Audio Based on a Circular Microphone Array," *Journal of Electrical and Computer Engineering*, vol. 2013, Article ID 718574, pp. 1-16, 2013.

M. Taseska and E. Habets, "Spotforming using distributed microphone arrays," *IEEE Workshop on Applications of Signal Processing to Audio and Acoustics*, Oct. 2013.

(56) References Cited

OTHER PUBLICATIONS

S. Rickard and O. Yilmaz, "On the approximate w-disjoint orthogonality of speech," in *Proc. Of ICASSP*, 2002, vol. 1, pp. 529-532.
O. Yilmaz and S. Rickard, "Blind separation of speech mixtures via time-frequency masking," *IEEE Trans. On Signal Process.*, vol. 52, pp. 1830-1847, 2004.
N. Ito et al., "Designing the wiener post-filter for diffuse noise suppression using imaginary parts of inter-channel cross-spectra," in *Proc. Of ICASSP*, 2010, pp. 2818-2821.
D. Pavlidi et al., "Real-time multiple sound source localization and counting using a circular microphone array based on a single-source confidence measures," in *Proc. Of ICASSP 2012*, 2012, pp. 2625-2628.
D. Pavlidi et al., "Real-time sound source localization and counting using a circular microphone array," *IEEE Trans. on Audio Speech, and Lang. Process*, vol. 21, No. 10, pp. 2193-2206, 2013.
L. Parra and C. Alvino, "Geometric source separation: merging convolutive source separation with geometric beamforming," *IEEE Transactions on Speech and Audio Processing*, vol. 10, No. 6, pp. 352-362, 2002.
V. Pulkki, "Virtual sound source positioning using vector based amplitude panning," *J. Audio Eng. Soc.*, vol. 45, No. 6, pp. 456-466, 1997.
J. Usher and J. Benesty, "Enhancement of spatial sound quality: A new reverberation-extraction audio upmixer," *IEEE Trans. on Audio Speech, and Lang. Process*, vol. 15, No. 7, pp. 2141-2150, 2007.
C. Faller and F. Baumgarte, "Binaural cue coding-part ii: Schemes and application," *IEEE Trans. on Speech and Audio Process*, vol. 11, No. 6, pp. 520-531, 2003.
M. Briand, et al., "Parametric representation of multichannel audio based on principal component analysis," in *AES 120th Conv.*, 2006.
M. Goodwin and J. Jot., "Primary-ambient signal decomposition and vector-based localization for spatial audio codding and enhancement," in *Proc. Of ICASSP*, 2007, vol. 1, pp. 1-9.
J. He et al., "A study on the frequency-domain primary-ambient extraction for stereo audio signals," in *Proc. Of ICASSP*, 2014, pp. 2892-2896.
J. He et al., "Linear estimation based primary-ambient extraction for stereo audio signals," *IEEE Trans. on Audio, Speech and Lang. Process.*, vol. 22, pp. 505-517, 2014.
C. Avendano and J. Jot, "A frequency domain approach to multichannel upmix," *J. Audio Eng. Soc*, vol. 52, No. 7/8, pp. 740-749, 2004.
O. Thiergart et al. "Diffuseness estimation with high temporal resolution via spatial coherence between virtual first-order microphones," in *Applications of Signal Processing to Audio and Acoustics* (*WASPAA*), 2011, pp. 217-220.
G. Carter et al, "Estimation of the magnitude-squared coherence function via overlapped fast fourier transform processing," *IEEE Trans. on Audio and Electroacoustics*, vol. 21, No. 4, pp. 337-344, 1973.
I. Santamaria and J. Via, "Estimation of the magnitude squared coherence spectrum based on reduced-rank canonical coordinates," in *Proc. Of ICASSP*, 2007, vol. 3, pp. III-985.
D. Ramirez, J. Via and I. Santamaria, "A generalization of the magnitude squared coherence spectrum for more than two signals: definition, properties and estimation," in *Proc. Of ICASSP*, 2008, pp. 3769-3772.
B. Cron and C. Sherman, "Spatial-correlation functions for various noise models," *J. Acoust. Soc. Amer.*, vol. 34, pp. 1732-1736, 1962.
H. Cox et al., "Robust adaptive beamforming," *IEEE Trans. on Acoust., Speech and Signal Process.*, vol. 35, pp. 1365-1376, 1987.

* cited by examiner

SOUND SOURCE CHARACTERIZATION APPARATUSES, METHODS AND SYSTEMS

CROSS-REFERENCE TO RELATED APPLICATIONS

This application claims priority under 35 U.S.C. §119 to U.S. Provisional Patent Application No. 61/706,073, filed Sep. 26, 2012, which is expressly incorporated by reference herein in its entirety.

This application may contain material subject to copyright or other intellectual property protection. The respective owners of such intellectual property have no objection to the facsimile reproduction of the disclosure as it appears in documents published by the U.S. Patent and Trademark Office, but otherwise reserve all rights whatsoever.

BACKGROUND

The subject matter disclosed herein relates generally to apparatuses, methods, and systems for sound source localization and source counting and more particularly, to SOUND SOURCE CHARACTERIZATION APPARATUSES, METHODS, AND SYSTEMS ("SSC").

SUMMARY

This summary is not intended to identify essential features of the claimed subject matter nor is it intended for use in determining or limiting the scope of the claimed subject matter.

A processor-implemented method for sound characterization is described. In one implementation, time-frequency transform of each of a plurality of sound signals from one or more sources, wherein the sound signals are detected by a plurality of sensing devices, is derived. One or more single-source constant-time analysis zones based at least on correlation between the time-frequency transform signals from a pair of sensing devices are detected. At least one direction of arrival for each source in the detected single source analysis zones are detected. A histogram of the estimated directions of arrival is created and an estimate of a number of the sound sources and corresponding directions of arrival are generated based at least on the histogram.

BRIEF DESCRIPTION OF THE DRAWINGS

Exemplary embodiments of the SSC are described with reference to the accompanying figures. In the figures, the left-most digit(s) of a reference number identifies the figure in which the reference number first appears. The same numbers are used throughout the figures to reference like features and components.

Figure 1:
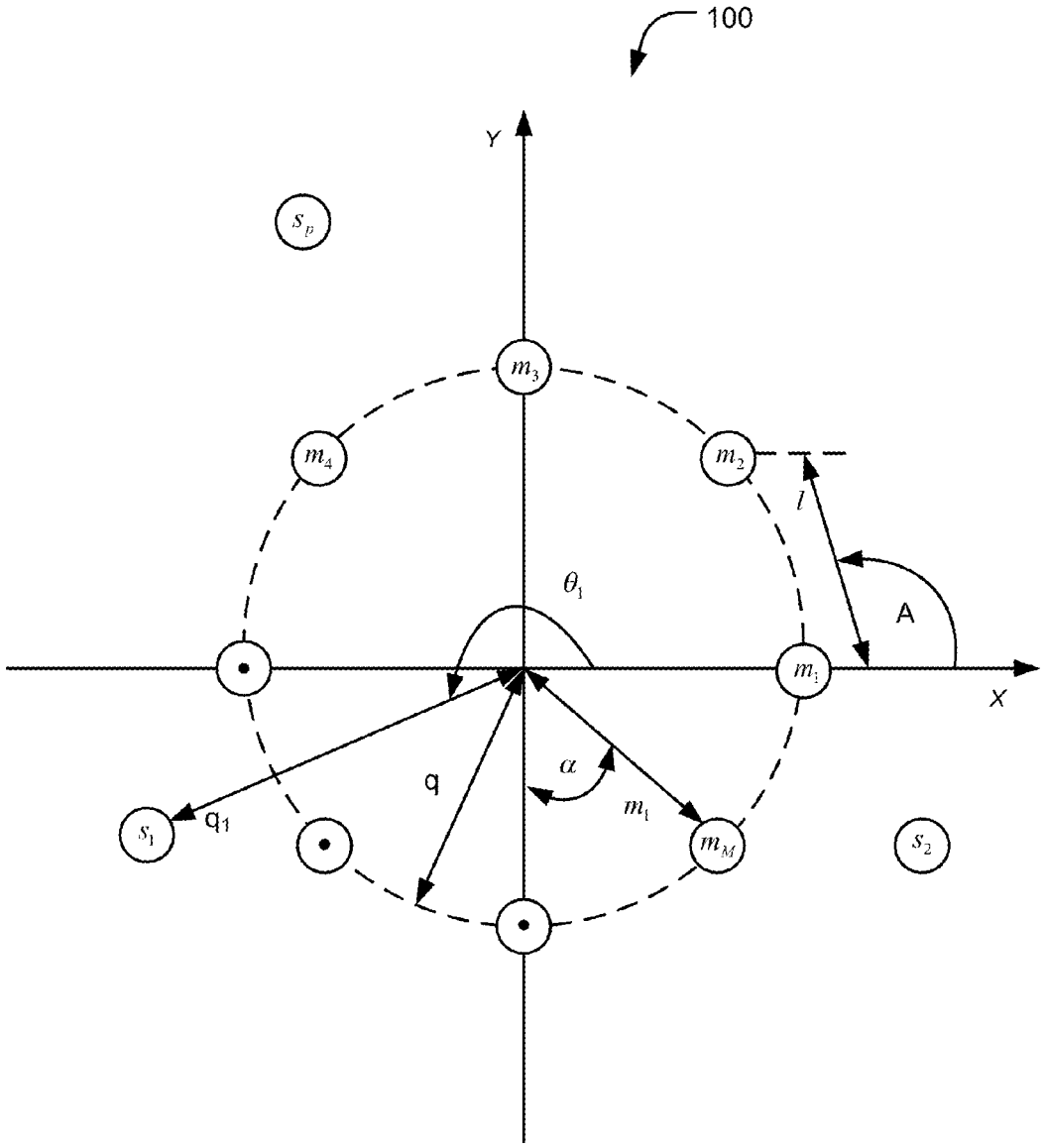
FIG. 1 is an exemplary environment configured to obtain and process sound signals to generate sound localization information, according to an embodiment of the present subject matter.

It should be appreciated by those skilled in the art that any block diagrams herein represent conceptual views of illustrative systems. Similarly, it should be appreciated that any flow charts, flow diagrams, state transition diagrams, pseudo code, and the like represent various processes, which may be substantially represented in a computer readable medium and so executed by a computer or processor, whether or not such computer or processor is explicitly shown.

DETAILED DESCRIPTION

SOUND SOURCE CHARACTERIZATION APPARATUSES, METHODS AND SYSTEMS ("SSC") are described herein.

Overview

Microphones may be used in conjunction with various methods to localize sound sources, such as to determine direction of arrival of signals from the sound sources in a variety of scenarios. For example, methods may be used to determine the location of speakers in a room during a teleconference. Such methods either focus on scenarios where only a single sound source or microphone is active, or provide computationally intensive solutions that cannot be executed efficiently in real-time where multiple sound sources are active simultaneously. Other methods rely on the assumption that sources do not overlap in small windows of time, which may true hold for speech in anechoic environments but not in reverberant conditions.

According to an embodiment, the SSC includes methods and systems to localize multiple, simultaneously active sources. In addition to accurate and efficient localization estimation, the SSC may also be configured to count the number of active sources at each time instant or at predefined time intervals. Such source counting and corresponding localization estimation may be performed by processing a mixture of signals/data received by a plurality of sensing devices, such as microphones arranged in an array, and by taking into account the known array geometry and/or correlation between signals from one or more pairs or other combinations of sensing devices in the array. In one embodiment, the sensing devices may be arranged in a circular array. In other embodiments, the devices may be arranged in an array having other configurations (e.g., triangle, square, straight or curved line or any other configuration).

Some embodiments described herein allow for joint DOA estimation and source counting. To this end, the SSC may partition the incoming signals/data from the sensing devices in overlapping time frames. The SSC may then apply a joint-sparsifying transforms to the incoming signals in order to locate single-source constant-time analysis zones. In one implementation, each single-source constant-time analysis zone is a set of frequency adjacent time-frequency points. The SSC may assume that for each source there exists at least one single-source constant time analysis zones, also referred to as single-source analysis zone, where that source is dominant over others. The cross-correlation and/or auto-correlation of the moduli of time-frequency transforms of signals from various pairs of microphones are analyzed to identify single-source constant-time analysis zones based at least on a correlation coefficient/measure.

In some embodiments, a strongest frequency component of a cross-power spectrum of time-frequency signals from a pair of microphones may be used to estimate a DOA for each of the sources relative to a reference axis. This may be performed either simultaneously or in an orderly manner for each of the detected single-source constant-time analysis zones. In other embodiments, a selected number of frequency components may be used for DOA estimation. The estimated DOAs for each sound source may be clustered and the DOA density function may be obtained for each source over one or more portions of the signals. A smoothed histogram may be obtained by applying a filter having a window length $h_N$ and a predetermined number of frames. Additionally or alternatively, in one implementation, the number of sources may also be estimated from the histogram of DOA estimates, such as by using peak search or linear predictive coding. In some embodiments, the number of sources may be estimated from the histogram of DOA estimates using a matching pursuit technique. Additionally, refined and more accurate values of DOAs are generated corresponding to each of the estimated sources based at least on the histogram.

Some embodiments of the methods and systems described herein can offer lower computational complexity and higher accuracy as compared to existing solutions for DOA estimation, can operate in both real-time and offline modes (some implementations operate with less than or about 50% of the available processing time of a standard computer), and provide relaxed sparsity constraints on the source signals compared to conventional methods. Some embodiments of SSC are configured to operate regardless of the kind of sensing array, array topologies, number of sources and separations, SNR conditions, and environments, such as, for example, anechoic/reverberant, and/or simulated/real environments. In an embodiment, the sparse representation of the observation signals in time-frequency domain, along with source counting using matching pursuit based techniques on histogram of DOA estimates, can improve accuracy and robustness in adverse environments.

SSC may find various applications in the field, such as for teleconferencing, where knowledge of the location of the speaker can be used to steer a camera, or to enhance the capture of the desired speaker's voice with beamforming, thus replacing lapel microphones. Other applications include, but are not limited to, event detection and tracking, robot movement in an unknown environment, different kinds of human-computer interaction, intelligent rooms, and next-generation hearing aids.

Certain embodiments of SSC may be configured for use in standalone devices (e.g., PDAs, smartphones, laptops, PCs and/or the like). Other embodiments may be adapted for use in a first device (e.g., USB speakerphone, Bluetooth microphones, Wi-Fi microphones and/or the like), which may be connected to a second device (e.g., computers, PDAs, smartphones and/or the like) via any type of connection (e.g., Bluetooth, USB, Wi-Fi, serial, parallel, RF, infrared, optical and/or the like) to exchange various types of data (e.g., raw signals, processed data, recorded data and or signals and/or the like). In such embodiments, all or part of the data processing may happen on the first device, in other embodiments all or part of the data processing may happen on the second device. In some embodiments there maybe more than two devices connected and performing different functions and the connection between devices and processing may happen in stages at different times on different devices. Certain embodiments may be configured to work with various types of processors (e.g., ARM, Raspberry Pi and/or the like).

While aspects of the described SSC can be implemented in any number of different systems, circuitries, environments, and/or configurations, the embodiments are described in the context of the following exemplary system(s) and circuit(s). The descriptions and details of well-known components are omitted for simplicity of the description.

The description and figures merely illustrate exemplary embodiments of the SSC. It will thus be appreciated that those skilled in the art will be able to devise various arrangements that, although not explicitly described or shown herein, embody the principles of the present subject matter. Furthermore, all examples recited herein are intended to be for illustrative purposes only to aid the reader in understanding the principles of the present subject matter and the concepts contributed by the inventor(s) to furthering the art, and are to be construed as being without limitation to such specifically recited examples and conditions. Moreover, all statements herein reciting principles, aspects, and embodiments of the present subject matter, as well as specific examples thereof, are intended to encompass equivalents thereof.

The term "frequency component" is used to indicate one among a set of frequencies or frequency bands of a signal, such as a sample of a frequency domain representation of the signal (e.g., as produced by a fast Fourier transform) or a subband of the signal (e.g., a Bark scale or mel scale subband).

A method as described herein may be configured to process the captured signal as a series of short-time segments. Typical segment lengths range from about five or ten milliseconds to about forty or fifty milliseconds, and the segments may be overlapping (e.g., with adjacent segments overlapping by 25% or 50%) or non-overlapping. In one particular example, the signal is divided into a series of non-overlapping time segments or "frames", each having a length of ten milliseconds. A segment as processed by such a method may also be a segment (i.e., a "subframe") of a larger segment as processed by a different operation, or vice versa.

FIG. 1 illustrates an exemplary environment 100 configured to obtain sound signals from one or more active sound sources, $s_1, s_2, \ldots s_p$, through a plurality of sound sensing devices, such as microphones $m_1, m_2 \ldots m_M$, and process the signals to provide sound localization information, such as number of sound sources, direction of arrival of each source, and the like. Even though the description relates to sound sensing devices arranged in an equispaced circular array, other configurations are also possible.

Assuming a free-field model, a sound signal $x_i(t)$ received at each microphone $m_i$ can be represented as:

$$x_i(t) = \sum_{g=1}^{P} a_{ig} s_g(t - t_i(\theta_g)) + n_i(t), \quad i = 1, \ldots M \tag{1}$$

Where P is the number of sound sources, $s_g$ is the signal from one of the P sound sources at a distance q from the center of the microphone array having a total of M microphones, $a_{ig}$ is the attenuation factor and $t_i(\theta_g)$ is the propagation delay from the $g^{th}$ source to the $i^{th}$ microphone, $\theta_g$ is the DOA of the source $s_g$ observed with respect to the x-axis, and $n_i(t)$ is an additive white Gaussian noise signal at microphone $m_i$ that is uncorrelated with the sound signals $s_g(t)$ and all other noise signals. It will be understood that even though a free-field model is described, the exemplary method and system can be configured to work robustly in simulated and/or real reverberant environments.

For a given source, the relative delay between sound signals received at adjacent microphones, hereinafter referred to as microphone pair, $\{m_i m_{i+1}\}$ with the last pair being $\{m_M m_1\}$, is given by:

$$\tau_{m_i m_{i+1}}(\theta_g) \equiv t_i(\theta_g) - t_{i+1}(\theta_g) = \frac{l\sin\left(A + \frac{\pi}{2} - \theta_g + (i-1)\alpha\right)}{c} \tag{2}$$

where $\alpha$ and 1 are the angle and distance between $\{m_i m_{i+1}\}$ respectively, A is the obtuse angle formed by the chord $\{m_1 m_2\}$ and the x-axis, and c is the speed of sound. In one embodiment, the DOA may be observed with respect to the x-axis, while in some other embodiments, the DOA can be observed with respect to a line perpendicular to the chord defined by the microphone pair $\{m_1 m_2\}$. Further, since the microphone array may be uniform, $\alpha$, A and l may be given by:

$$\alpha = \frac{2\pi}{M}, A = \frac{\pi}{2} + \frac{\alpha}{2}, l = 2q\sin\frac{\alpha}{2} \tag{3}$$

where q is the array radius. The angles in equations 1, 2, and 3 may be in radians.

In one embodiment, exemplary methods and systems can be communicatively coupled to the sensing devices, such as microphones, to obtain signals and derive data related to source localization and to count the total number of active sources. In operation, the exemplary systems receive the signals captured by the plurality of sensing devices, and process received signals/data based at least on one or more parameters, such as array geometry, type of environments, and the like, to either estimate the number of the active sources, or their corresponding DOAs or both.

The processing of signals for determination of source localization information may include, but is not limited to, representing the received signals in a time-frequency domain; detecting single-source constant-time analysis zones for the time-frequency representation of the incoming signals based at least on cross-correlations and auto-correlations between time-frequency signals from various combinations of microphone pairs (or adjacent pairs); estimating DOAs in the single-source constant-time analysis zones; generating and/or smoothing of a histogram formed from a block of DOA estimates; and estimating the number of active sources and/or corresponding refined DOAs with one or more of source counting components, for example, a matching pursuit component, a peak-search component, or a linear predictive coding component. The details of the exemplary systems and methods are described in subsequent paragraphs.

Figure 2:
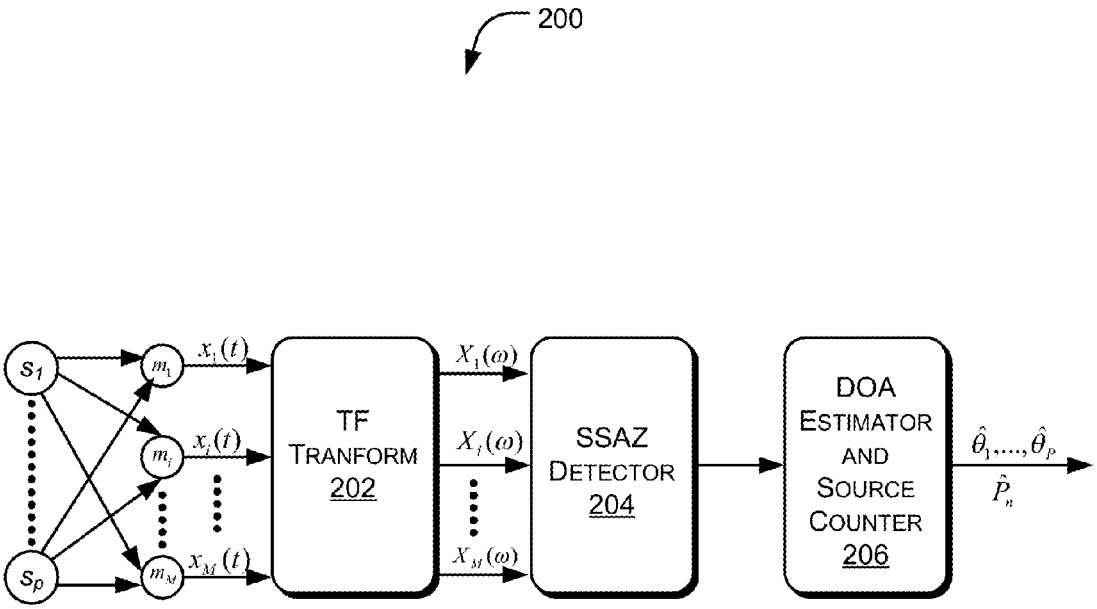
FIG. 2 is an exemplary block diagram of an SSC system, according to an embodiment of the present subject matter.

FIG. 2 illustrates exemplary components of an SSC system 200. In one embodiment, the SSC system 200 includes one or more sound sources, $s_1, s_2, \ldots s_p$. In an exemplary embodiment, the sound sources can be one or more speakers participating in a teleconference. In one implementation, the SSC 200 is configured to estimate the number of sources and/or corresponding DOAs. In some implementations, the SSC system 200 assumes that at least one active source is present.

The system 200 further includes a plurality of sound sensing devices labeled 1 to M, capable of detecting mechanical waves, such as sound signals, from one or more sound sources. In some embodiments, the devices may be microphones. Some embodiments may be configured to work with various types of microphones (e.g., dynamic, condenser, piezoelectric, MEMS and/or the like) and signals (e.g., analog and digital). The microphones may or may not be equispaced and the location of each microphone relative to a reference point and relative to each other may be known. Some embodiments may or may not comprise one or more sound sources, of which the position relative to the microphones may be known. Furthermore, the microphones may be arranged in the form of an array. The microphone array can be, for example, a linear array of microphones, a circular array of microphones, or an arbitrarily distributed coplanar array of microphones. The description hereinafter may relate to circular microphone arrays; however, similar methodologies can be implemented on other kind of microphone arrays.

Although mostly discussing audible sound waves, the SSC 200 may be configured to accommodate signals in the entire range of frequencies and may also accommodate signals in the entire range of frequencies and may also accommodate other types of signals (e.g., electromagnetic waves and/or the like).

Each of the sound signals received by the microphones in the microphone array can include the sound signal from a sound source(s) located in proximity to the microphone or preferred spatial direction and frequency band among other unsuppressed sound signals from the disparate sound sources and directions, and ambient noise signals.

In one implementation, the mixture of signals received at each of the microphones $m_1, m_2, \ldots m_M$ can be represented by $x_1(t), x_2(t), \ldots, x_M(t)$, respectively. According to an implementation, each $x_i(t)$ can be represented by equation (1). The signals are received by a time-frequency (TF) transform module 202, which provides a time-frequency representation of the observations/received signals. In an embodiment, the TF transform module 202 can implement a short-term Fourier transform (STFT) as a sparsifying transform to partition the overall time-frequency spectrum into both time and frequency domains as a plurality of frequency bands ("slices") extending over a plurality of individual time slots ("slices") on which the Fourier transform is computed. Other sparsifying transforms may be employed in a similar manner.

In some embodiments, single-source constant-time analysis zone (SSAZ) detector 204 can also detect single-source constant-time analysis zones $(t,\Omega)$, referred to as $(\Omega)$ for simplicity hereinafter, as a series of frequency-adjacent TF points (t, ω). For each source, there is assumed to be at least one single-source constant-time analysis zone (SSAZ) where a single source is isolated, i.e., a zone where a single source is dominant over others. The sources can overlap in TF domain except in one or more of such SSAZs. Further, in one implementation, if several sources are active in the same SSAZ, they vary such that the moduli of at least two observations are linearly dependent. This allows processing of correlated sources, contrary to classical statistic-based DOA methods.

In one implementation, the SSAZ detector 204 detects one or more single-source constant-time analysis zones by determining cross-correlations and auto-correlations $R'_{i,j}(\Omega)$ and $R'_{i,i}(\Omega)$ of the moduli of the time-frequency transforms of signals ($x_i$, $x_j$) from pairs of sensing devices $\{m_i m_j\}$ as:

$$R_{i,j}(\Omega) = \sum_{\omega\in\Omega} X_i(\omega)\cdot X_j(\omega)^* \tag{4}$$

$$R'_{i,j}(\Omega) = \sum_{\omega\in\Omega} |X_i(\omega)\cdot X_j(\omega)| \tag{5}$$

Where $X_i(\omega)$ is the TF transform of $x_i(t)$, $X_j(\omega)$ is the TF transform of $x_j(t)$ and * stands for the complex conjugate.

The SSAZ detector then derives the associated correlation coefficient, i.e., $r'_{i,j}(\Omega)$ using:

$$r'_{i,j}(\Omega) = \frac{R'_{i,j}(\Omega)}{\sqrt{R'_{i,i}(\Omega)\cdot R'_{j,j}(\Omega)}} \tag{6}$$

In one implementation, correlation between all possible pairs of sensing devices $\{m_i m_j\}$ are considered and the SSAZ detector 204 can identify all zones (Ω) for which the following condition is satisfied:Ω):

$$r'_{i,j}(\Omega)=1\forall i,j\epsilon\{1,\ldots,M\} \tag{7}$$

In another implementation, average correlation, $\overline{r}'(\Omega)$, between adjacent pairs of sensing devices $\{m_i m_{i+1}\}$ is considered. Additionally or alternatively, the SSAZ detector 204 can identify all zones (Ω) for which the following condition is satisfied:

$$\overline{r}'(\Omega)\geq 1-\epsilon \tag{8}$$

Where ϵ is a system or user-defined threshold.

In yet another implementation, a desired combination of microphones may be used for calculation of correlation coefficient $r'_{i,j}(\Omega)$ to detect SSAZs. In one example, such a selection can be made via a graphical user interface. In another example, the selection can be adaptively changed as per environment or system requirements.

In one implementation, the detected SSAZs may be used by the DOA estimator and source counter 206 to derive the DOA estimates for each source in each of the detected SSAZs based at least on a cross-spectrum over all or selected few microphone pairs.

Since the estimation of the DOA occurs in an SSAZ, the phasor of the cross-power spectrum $R_{i,i+1}(\omega)$ of a microphone pair $\{m_i m_{i+1}\}$, or $\{m_i m_j\}$ as the case may be, is evaluated over a frequency range of the specific zone as:

$$G_{m_i m_{i+1}}(\omega) = \angle R_{i,i+1}(\omega) = \frac{R_{i,i+1}(\omega)}{|R_{i,i+1}(\omega)|},\ \omega\in\Omega \tag{9}$$

where the cross-power spectrum $R_{i,i+1}(\omega)$ may be defined as:

$$R_{i,i+1}(\omega) = \sum_{\omega\in\Omega} X_i(\omega)\cdot X_{i+1}(\omega)^* \tag{10}$$

In one implementation, the DOA estimator and source counter 206 then computes phase rotation factors using:

$$G^{(\omega)}_{m_i m_{i+1}}(\phi) \equiv e^{-j\omega\tau_{m_i\to m_1}(\phi)}$$

Where $\tau_{m_i\to m_1}(\phi)\equiv\tau_{m_1 m_2}(\phi)-\tau_{m_i m_{i+1}}(\phi)$ is the difference in the relative delay between the signals received at pairs $\{m_1 m_2\}$ and $\{m_i m_{i+1}\}$, where $\tau_{m_i m_{i+1}}(\phi)$ may be evaluated according to equation 2, $\phi\epsilon[0,2\pi)$, in radians, $\omega\epsilon\Omega$. In one implementation, the circular integrated cross spectrum can be estimated using:

$$CICS^{(\omega)}(\phi) \equiv \sum_{i=1}^{M} G^{(\omega)}_{m_1\to m_1}(\phi) G_{m_i m_{i+1}}(\omega) \tag{12}$$

Based on the CICS, the estimated DOA associated with a frequency component ω in the single-source constant-time analysis zone with frequency range Ω can be given by:

$$\hat{\theta}_\omega = \arg\max_{0\leq\phi<2\pi} |CICS^{(\omega)}(\phi)|$$

In one implementation of the DOA estimator and source counter 206, a selected range or value(s) of ω are used for estimation of DOA in a single-source constant-time analysis zone. For example, in one implementation, $\omega_i^{max}$ frequency, which corresponds to the strongest component of the cross-power spectrum of the microphone pair $\{m_i m_{i+1}\}$ in a single source zone. By definition, $\omega_i^{max}$ is the frequency where the magnitude of cross-power spectrum $R_{i,i+1}(\omega)$ reaches its maximum and can be given by:

$$\omega_i^{max} = \underset{\Omega}{\operatorname{argmax}}\left|R_{i,i+1}(\omega)\right|$$

In an example, $\omega_i^{max}$ gives a single DOA corresponding to each SSAZs.

In another implementation, d frequency components are used in each single-source constant-time analysis zone. For example, frequencies that correspond to the indices of the d highest peaks of the magnitude of the cross-power spectrum $R_{i,i+1}(\omega)$ over all or selected microphone pairs $\{m_i m_j\}$ are used. The DOA estimator and source counter 206 thus yields d estimated DOAs from each SSAZ, thereby improving the accuracy of the system 200 as more frequency components lead to lower estimation error. The selection of d frequency components may be based on desired level of accuracy and performance and can be modified based on the real-time application where the system is implemented.

It will be understood that several single-source constant-time analysis zones may lead to the same DOA estimate, as the same isolated source may exists in all such zones. In one implementation, the DOA estimator 206 derives DOA for each source by clustering the estimated DOAs, which can be done by creating a histogram for a particular time segment; and then finding peaks in the histogram. In other implementations, DOAs can and such data-distribution can be represented in other ways, such as bar charts, etc.

Figure 3:
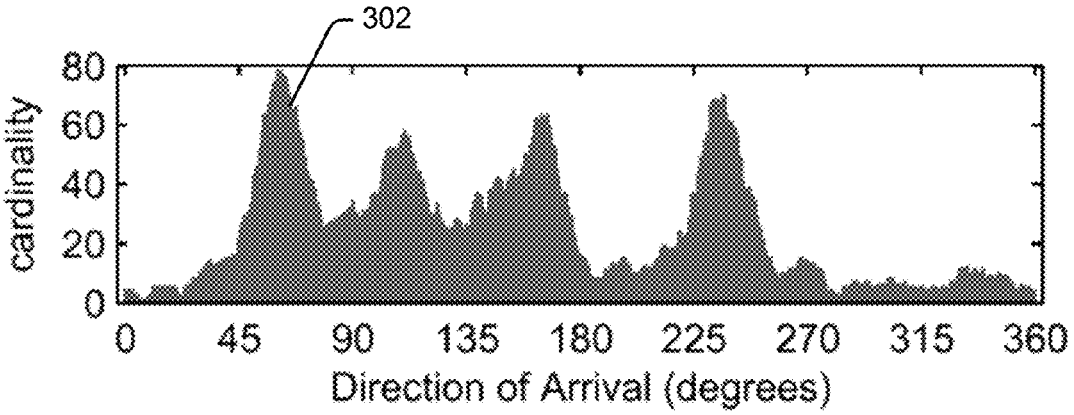
FIG. 3 is an exemplary histogram of estimates of directions of arrival (DOAs), according to an embodiment of the present subject matter.

Alternatively or additionally, once all the local DOAs have been estimated in each of the identified single-source constant-time analysis zones, the DOA estimator and source counter 206 creates a histogram from the set of estimations, for example in a block of B consecutive time frames. Any erroneous estimates of low cardinality, due to noise and/or reverberations only add a noise floor to the histogram. Further, in some embodiments, a smoothed histogram is obtained from the histogram. Additionally, a density function P(v) of the estimations is obtained by applying an averaging filter with a window, for example a rectangular window, of length $h_N$ over the estimations of the block. Therefore, if each bin of the smoothed histogram is denoted as v, the probability density function P(v) is given by:

$$P(v) = \frac{1}{N}\sum_{i=1}^{N}\frac{w}{h_N}\left(\frac{v - v_i}{h_N}\right),\ 0 \le v < 2\pi \tag{15}$$

where N is the total number of estimates in a block; $h_N$, is the length of the window, and w(.) is the rectangular window Alternatively, for a circular array of microphones, the cardinality y(v) can be given by:

$$y(v) = \sum_{i=1}^{N}\frac{w}{h_N}\left(\frac{v \times 360/L - \zeta_i}{h_N}\right),\ 0 \le v < L \tag{16}$$

Where L is the number of bins or frequency components in the histogram, $\zeta_i$ is the $i^{th}$ estimate (in degrees) out of N estimates in a block, and w( ) is the rectangular window of length $h_N$. An example of a smoothed histogram 302 of four sources at 60°, 105°, 165°, and 240° at 20 dB SNR of additive white Gaussian noise is shown in FIG. 3.

Given $y_N$, that is the length-L smoothed histogram in 302 the $n^{th}$ frame, the DOA estimator and source counter 206 estimates the number of active sources $\hat{P}_N$ and their DOAs $\hat{\theta}_i$. In one implementation, the DOA $\hat{\theta}_i$ for each source can be estimated using:

$$\hat{\theta}_i = \frac{h_N N \sum_{j=ll}^{lh} j \cdot P(j)}{\sum_{j=ll}^{lh} P(j)} \left\{ \begin{array}{l} ll = k - h_N/2 \\ lh = k + h_N/2 \end{array} \right\} \tag{17}$$

where i=1, . . . $\hat{P}_N$. The index k is one of the P highest local peaks of P(v) and there is 1 to 1 correspondence between i and k, N is the total number of estimates in a block $h_N$, is the length of the window, and w(.) is the rectangular window. In one example, the P highest local peaks are selected under the constraint that the peaks are "distant-enough", i.e., separated by a user defined threshold 6. In one implementation, the block of DOA estimates slides with each new time frame.

In other implementations, the DOA estimator and source counter 206 applies one or more methods that robustly estimate the number of active sources. To this end, the DOA estimator and source counter 206 may include at least one of a peak search module (not shown), a linear predictive coding (LPC) module (not shown), and/or a matching pursuit module (not shown) to count the number of active sources under the constraint that the maximum number of active sources may not exceed a user or system defined upper threshold $P_{max}$.

In one implementation, the peak search module performs peak search on the histogram or smoothed histogram 302 in the following manner: Some implementations assume at least one active source in a block of estimates, however other implementations are also possible. According to an implementation, the peak search module sets $i_s$=1, where $i_s$ corresponds to a counter of the peaks assigned to sources so far. The peak search module can also set $u_{i_s}=u_1$=arg max y(v), i.e., the histogram bin which corresponds to the highest peak of the smoothed histogram 302. Finally, peak search module can also the threshold $z_{i_s+1}$=max $\{y(u_{i_s})/2, z_{static}\}$, where $z_{static}$ which may be a user-defined static threshold or a non-static peak threshold.

In one implementation, the peak search module then locates the next highest peak in the smoothed histogram 302, $y(u_{i_s+1})$. It can then determine whether one or more of the following conditions are satisfied:

$$\begin{aligned} & y(u_{i_s+1}) \ge z_{i_s+1} \\ & u_{i_s+1} \notin \left[u_{j_s} - \frac{u_w L}{360°}, u_{j_s} + \frac{u_w L}{360°}\right], \forall u_{j_s} \\ & j_s < (i_s + 1) \end{aligned} \tag{18}$$

If so, then $i_s=i_s+1$ and $z_{is+1}=\max\{y(u_{is})/2, z_{static}\}$. $u_w$ is the minimum offset between neighboring sources. The first condition of equation 18 guarantees that the next located histogram peak is higher that the updated threshold $z_{is+1}$. While the other two conditions in equation 18 guarantee that the next located peak is not in the close neighborhood of an already located peak with $j_s$=1, . . . , $i_s$ and $u_{j_s}$ all the previously identified source peaks.

Figure 4:
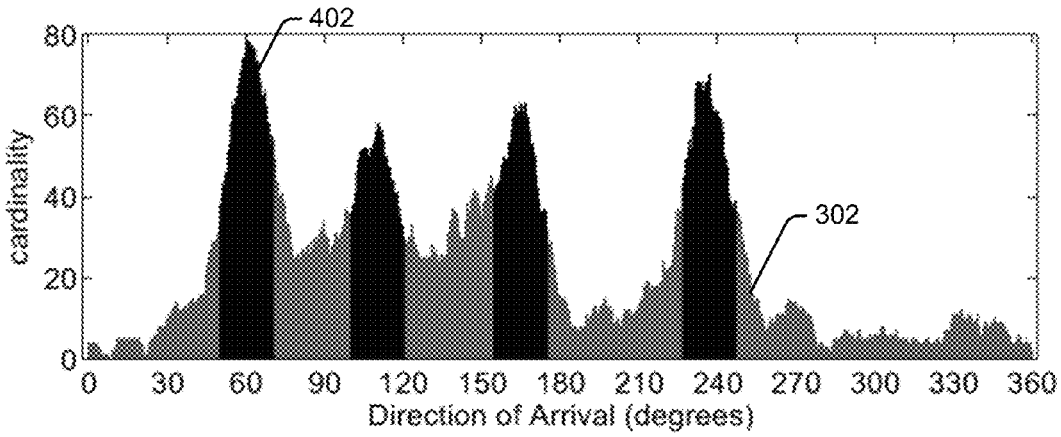
FIG. 4 is an exemplary histogram of direction of arrival (DOA) estimates overlapping with an exemplary peak-plot generated by a peak search module, according to an embodiment of the present subject matter.

The peak search module stops counting when a peak in the histogram 302 fails to satisfy the threshold $z_{is+1}$ or if the upper threshold $P_{max}$ is reached and yields the estimated number of sources as $\hat{P}_N=i_s$. An exemplary plot 402 generated by the peak search module is shown in FIG. 4. The black areas in the plot 402 indicate the bins around a tracked peak of the smoothed histogram that are excluded as candidate source indicators.

In another implementation, the source counter 206 implements the LPC module to estimate the number of sources. LPC coefficients can be used to provide an all-pole smoothed spectral envelope of speech and audio signals. The spectral envelope thus obtained may be used to identify the peaks of the smoothed histogram 302 and to suppress any noisy areas. In one implementation, the LPC module represents the envelope of the histogram 302 with its LPC-smoothed counterpart from which the total number of peaks is chosen as an estimate of the total number of active sources, $\hat{P}_N$.

In another implementation, the LPC module counts the number of active sources $\hat{P}_N$ by applying LPC of an optimum order to the smoothed histogram of DOA estimates. The order of the LPC may be configurable based on the application. Further, the LPC may be selected based on results from a variety of simulation scenarios.

Figure 5:
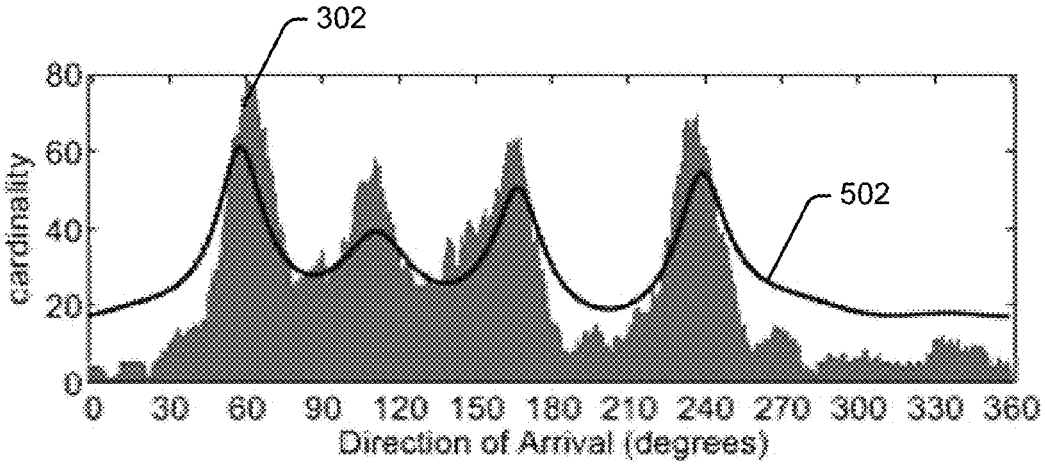
FIG. 5 is an exemplary histogram of DOA estimates overlapping with an exemplary linear predictive coding (LPC) curve generated by an LPC module, according to an embodiment of the present subject matter.

In one implementation, the LPC module emphasizes the peaks and suppresses any noisy areas, such that the LPC envelope coincides with the envelope of the histogram. The LPC module generates the estimated number of active sources $\hat{P}_N$ by counting the local maxima in the LPC envelope with a constraint, for example, $\hat{P}_N \leq P_{max}$. An exemplary curve generated by the LPC module is shown in FIG. 5. The black curve 502 corresponds to the LPC estimated envelope of the histogram 302.

In yet another implementation, the matching pursuit module is used to identify the peaks of the smoothed histogram 302, in other words DOA of a possible source, by correlation with a modeled source atom, such as a smooth pulse of a Blackman window having variable and/or modifiable width. The matching pursuit module then estimates the contribution of each source, and removes the contribution until the contribution is insignificant according to predetermined criteria, or until the maximum number of sources have been identified, i.e., $\hat{P}_N \leq P_{max}$. Accordingly, the matching pursuit module jointly estimates the number of sources and their corresponding refined DOAs. Thus, as shown in FIG. 2, the DOA estimator and source counter 206 yields DOAs specific to sources $s_1$ and $s_p$. Even though two DOAs are shown, it will be understood that multiple angles may be generated.

It will be understood for one source, one may get several DOAs from difference single-source constant-time analysis zones because of noisy estimation procedure while using cross-power spectrum over zones. But by using histogram, as per some embodiments, a more accurate value of DOA among all the estimates can be obtained.

Figure 6:
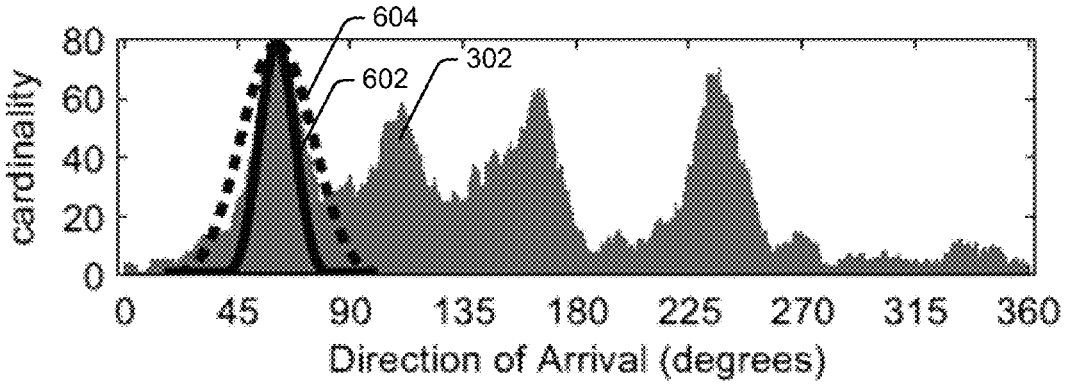
FIG. 6 is an exemplary histogram of DOA estimates overlapping with an exemplary source atom modeled by a matching pursuit module, according to an embodiment of the present subject matter.

Source counting via the matching pursuit module is further explained with the example of circular microphone arrays. Consider the exemplary histogram 302 of four active sources at 20 db SNR and then consider the sparse approximation using source atoms with variable widths in FIG. 6. The two fixed-width atoms provide a compromise between accuracy, resolution, and computational complexity. Thus, while narrower width 602 provides accurate location of the each peak, wider width source atom 604 provides better approximation of contribution of each peak to the overall histogram. In one implementation, the wider width source atom is centered on the same index as the narrower one as shown in FIG. 6.

In one implementation, the correlation of the source pulse with the histogram is done in a circular manner, as the histogram wraps from 359° to 0°. In one implementation, the matching pursuit module forms a matrix whose rows (or columns) include wrapped and shifted versions of the source pulse described subsequently. The matching pursuit module selects b as a length-row vector having a length-Q Blackman window, u as a length-row vector whose first Q values are populated with b and then padded with L-Q zeros. Also, $u^{(k)}$ denotes a version of that has been "circularly" shifted to the right by elements, the circular shift means that the elements at either end wrap around, and a negative value of implies a circular shift to the left. The matching pursuit module selects $Q=2Q_0+1$ where $Q_0$ is a positive integer. In an example, the maximum value of b (or equivalently u) occurs at $(Q_0+1)$-$^{th}$ position. The matching pursuit module then defines $c=u^{(-Q)}{}_0$. The maximum value of the length-L row vector c can occur at its first element. Elements of c can be denoted as $c_i$, and its energy can be given by $E_c=\Sigma c_i^2$. The matching pursuit module then forms matrix C, which consists of circularly shifted versions of c. Specifically, the k-$^{th}$ row of C is given by $c^{(k-1)}$. For the two widths of source atoms, the matching pursuit module assigns $C_N$ and $C_W$ as matrices for the peak detection (denoted by "N" for narrow) and the masking operation (denoted by "W" for wide), respectively, with corresponding source atom widths $Q_N$ and $Q_W$. In order to estimate the number of active sources, the matching pursuit module creates γ a length-$P_{max}$ vector whose elements $\gamma_j$ are predetermined thresholds, representing the relative energy of the $j^{th}$ source. The matching pursuit module then performs joint source counting and DOA estimation as follows:

a. Set the loop index j=1 b. Form the product $a=C_N y_{n,j}$ c. Let the elements of a be given by $a_i$, find $$i^* = \arg\max_i a_i$$

such that i* is further than $u^w \times L/360°$ from all formerly located maximum indices, where $u^w$ denotes a minimum offset between neighboring sources.

d. The DOA of each source is given by:

$$(i^*-1)\times 360°/L$$

e. Calculate the contribution of the source as:

$$\delta_j = (c_W^{i^*-1})^T \frac{a_i}{E_{CN}}$$

f. If $\delta_j < \gamma_j$, go to step g, else go to step k.

g. Remove the contribution of this source as:

$$y_{n,j+1} = y_{n,j} - \delta_j$$

h. Increment j.

i. If $j \leq P_{max}$ go to step b, else go to step k.

k. $\hat{P}_N = j-1$ and the corresponding DOAs are those estimated in step d.

The matching pursuit module thus yields $\hat{P}_N$ as the total number of active sources along with their DOAs $\hat{\theta}_i$ calculated at step d above. The matching pursuit approach is computationally-efficient as source counting and DOA estimation can be done in real-time. Real-time may refer to the response of the system within the strict time constraint defined by the duration of the time frame. In another implementation, $C_N$ and $C_W$ that are circulant matrices include L-$Q_N$ and L-Qw zeros in each row, respectively and both these properties may be exploited to provide a reduced computational load.

Figure 7:
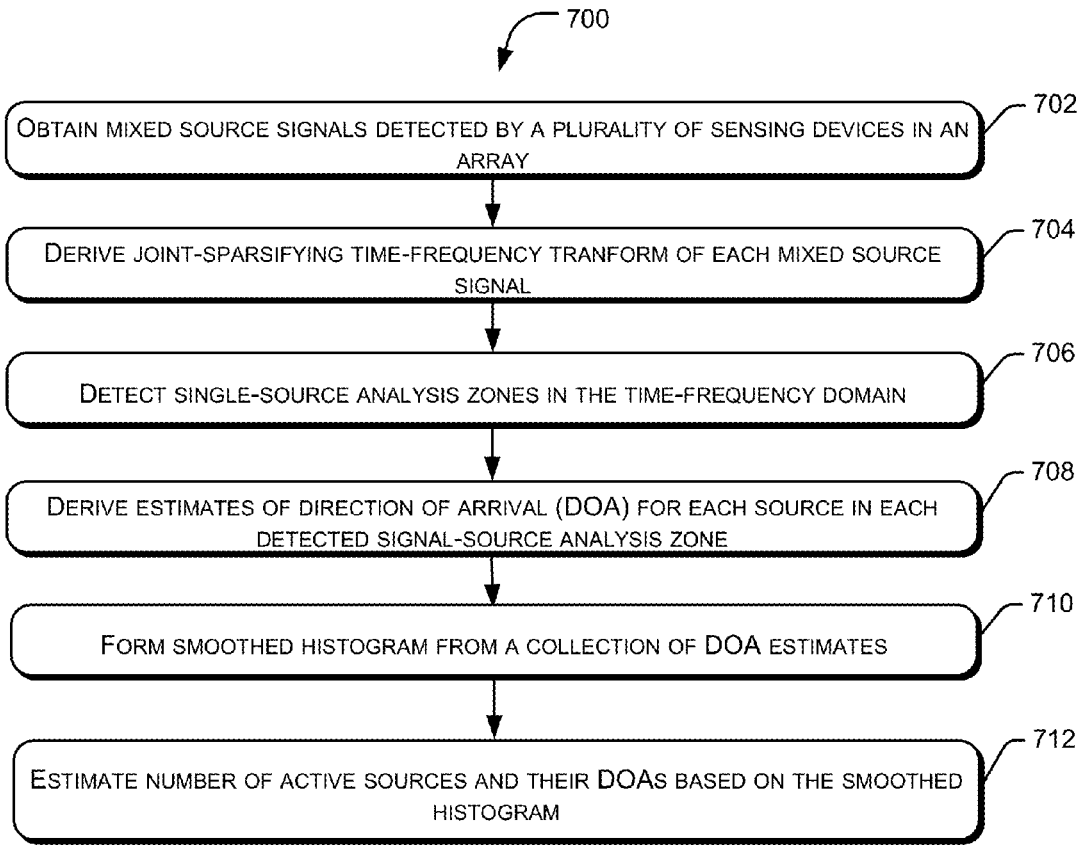
FIG. 7 is an exemplary method for sound source localization, according to an embodiment of the present subject matter.
Figure 8:
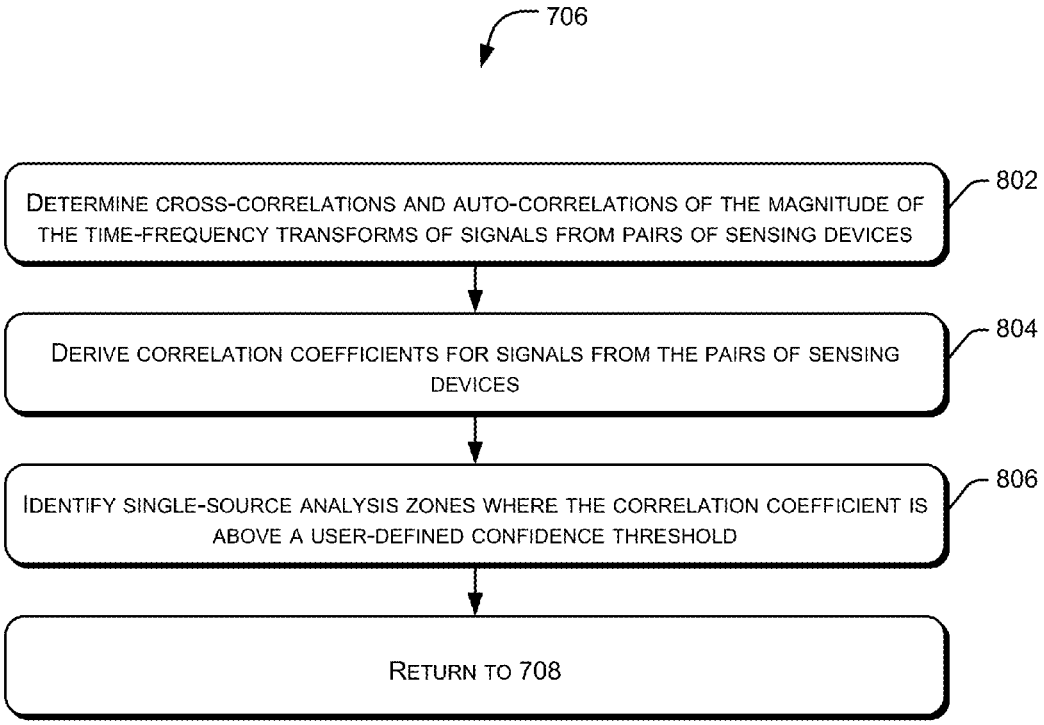
FIG. 8 is an exemplary method to detect one or more single-source constant-time analysis zones, according to an embodiment of the present subject matter.
Figure 9:
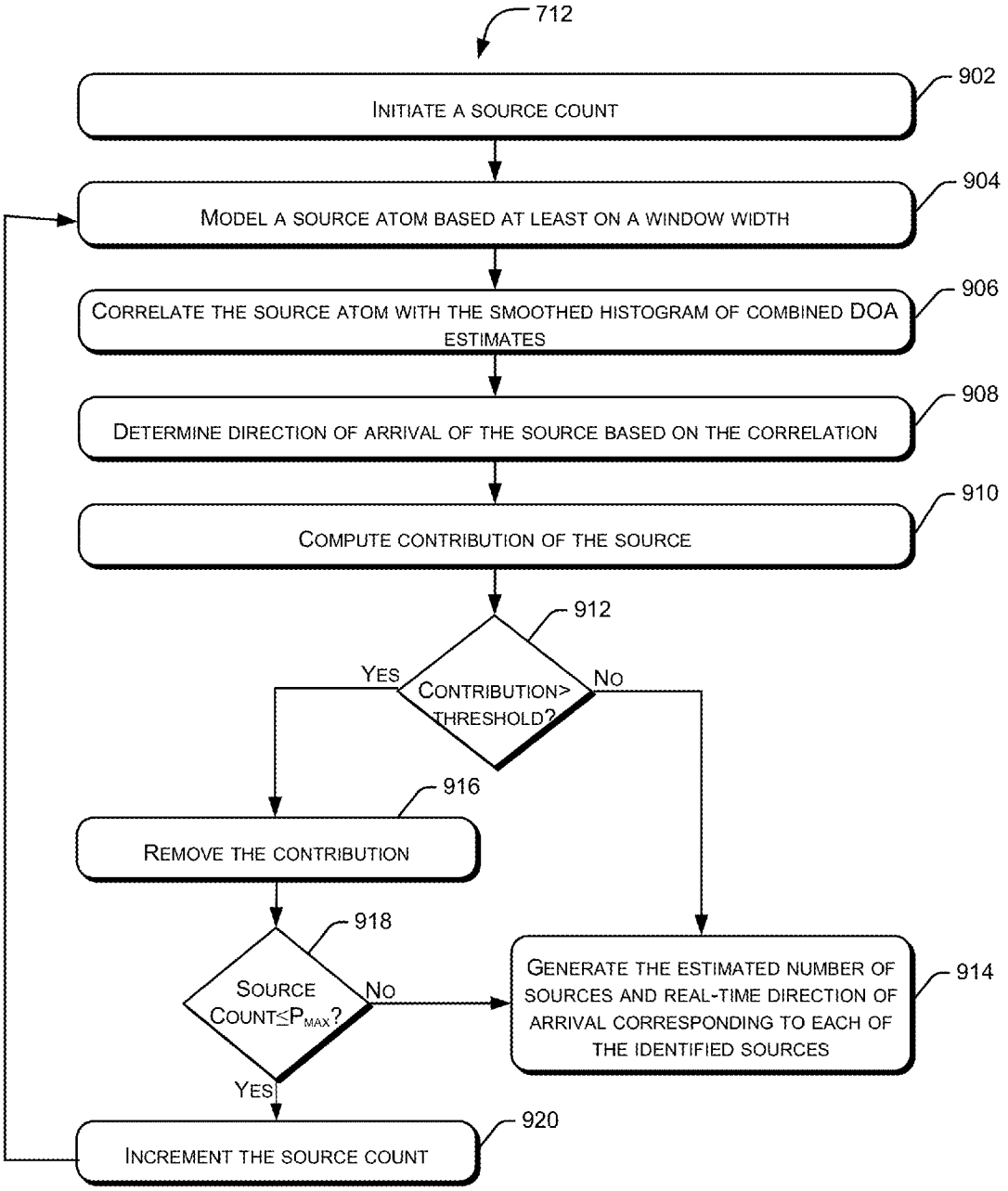
FIG. 9 is an exemplary method to estimate the number of sound sources, according to an embodiment of the present subject matter.

FIG. 7 illustrates an exemplary method 700 for sound source localization, according to an exemplary embodiment of the present subject matter. FIGS. 8 and 9 illustrate detection of single source segments, and counting of sound sources, respectively. The order in which the methods are described are not intended to be construed as a limitation, and any number of the described method blocks can be combined in any order to implement the methods, or an alternative method. Additionally, individual blocks may be deleted from the methods without departing from the spirit and scope of the subject matter described herein. Furthermore, the methods can be implemented in any suitable hardware, software, firmware, or combination thereof.

The exemplary methods may be described in the general context of computer executable instructions. Generally, computer executable instructions can include routines, programs, objects, components, data structures, procedures, modules, functions, etc., that perform particular functions or implement particular abstract data types. The methods may also be practiced in a distributed computing environment where functions are performed by remote processing devices that are linked through a communications network. In a distributed computing environment, computer executable instructions may be located in both local and remote computer storage media, including memory storage devices.

At block 702, mixed source signals, detected by a plurality of sensing devices in an array, are obtained. In one implementation, mixed source signals from one or more sources, such as sound sources, are detected by a plurality of sensing devices, such as microphones. For example, the mixed source signals include signals from the source in proximity to the microphone and unsuppressed signals from other sources, such as adjacent sources, and ambient noise signals. The microphones may be arranged in any known configuration, such as circular, linear, etc.

At block 704, joint-sparsifying time-frequency transform of each of the received mixed source signal is obtained. In one implementation, the received mixed source signals are segmented into a plurality of overlapping time frames on which sparsifying transform, such as STFT. The time-frequency representation allows location of SSAZs, each of which represents a series of frequency adjacent TF points for which t is constant.

At block 706, single-source constant-time analysis zones in the time-frequency domain are detected. The single-source constant-time analysis zones, in one implementation, are a time-frequency windows or zones in which one source is dominant over others. And if several sources are active in the same zone, the assumption is that the signals from the two sources vary so that the moduli of at least two observations are linearly dependent. This allows processing of correlated sources, contrary to classical statistic-based DOA methods. In one implementation, the single-source constant-time analysis zones are detected based at least on correlation coefficients/confidence measures. In one implementation, the correlation coefficients can be obtained using cross-correlations and auto-correlations between signals from pairs of sensing devices. The zones that do not meet predefined criteria are discarded. At block 708, estimates of DOA for each source in each of the detected single-source constant-time analysis zones are derived. In one implementation, DOA estimates may be based on d frequency components in each single-source constant-time analysis zone, i.e., the use of those frequencies that correspond to the indices of the d highest peaks of the magnitude of the cross-power spectrum over all or selected number of sensing devices. In another example, the DOA estimates may be based on the strongest frequency component of the cross-power spectrum of the pair of sensing devices in a single-source constant-time analysis zone, giving us a single DOA for each single-source constant-time analysis zone. The number of DOA estimates per SSAZ may be based on a desired level of accuracy and computational efficiency.

At block 710, a smoothed histogram is formed from the collection of DOA estimates. In one implementation, several single-source constant-time analysis zones may lead to the same DOA as the isolated source is the same in each of them. Deriving the DOA for each sound source involves clustering the estimated DOAs, which can be done by first forming a histogram from the set of estimations in a block of B consecutive frames and then by finding peaks in their histogram for the particular time frame. In one implementation, a smoothed histogram can be obtained by applying Parzen windows, or an average filter with a window of length $h_N$. In other implementations, density function, such as probability density function v, of the estimated DOAs in each of the single-source constant-time analysis zones can be obtained. The density functions v can then be used to cluster one or more estimated DOAs and generate source-specific DOAs.

At block 712, the number of active sources $\hat{P}_N$ and their DOAs are estimated from the smoothed histogram. In one implementation, one of the source counting modules from amongst peak search module, LPC module, or matching pursuit module is selected and the sound sources are counted based at least on the combined DOA using the selected counting module. Other statistical methods for counting sources and/or detecting peaks are contemplated by the present subject matter.

In one implementation, the peak search module counts the number of active sources $\hat{P}_N$ by performing a peak search on the smoothed histogram by using a static or non-static peak threshold.

In another implementation, the LPC module counts the number of active sources $\hat{P}_N$ by applying LPC of an optimum order to the smoothed histogram of DOA estimates. The order of the LPC may be configurable based on the application. Further, the LPC may be selected based on results from a variety of simulation scenarios.

In one implementation, the LPC module emphasizes the peaks and suppresses any noisy areas, such that the LPC envelope coincides with the envelope of the histogram. The LPC module generates the estimated number of active sources $\hat{P}_N$ by counting the local maxima in the LPC envelope with a constraint, for example, $\hat{P}_N \leq P_{max}$.

In certain scenarios, a high order of LPC may over-fit the histogram of estimates, leading to an over-estimation of the actual number of active sources. In some other scenarios, a low order LPC risks the detection of less dominant sources, i.e., the sources with less estimates in the histogram. For example, a $16^{th}$ order LPC is considered optimum for source counting in an example.

In yet another implementation, a matching pursuit module is used to generate an estimate of the number of active sources by picking the peaks of the smoothed histogram by correlation and then removing the contribution of each source. The process is repeated until the contribution of the source is insignificant according to a preset criteria and/or a maximum number of active sources has been identified. The peaks are identified using one or more source atoms of an equal or variable width. The matching pursuit module also generates DOA estimation in real-time. This is further explained in FIG. 9.

In one implementation, the estimated number of active sources and corresponding refined DOA estimates can be displayed on a user interface in one or more formats, such as graphs, tables, etc. Based on such data, additional activities can be performed. For example, accurate knowledge of the location of the source can be used to steer a camera or to enhance the capture of the desired source with beamforming. These are examples of some of the applications, additional applications are possible as will be understood by a person skilled in the art.

Referring to FIG. 8, identification of one or more SSAZs is described. At block 802, cross-correlations and auto-correlations of the magnitude of the time-frequency transforms of signals $(x_i, x_j)$ from pairs of sensing devices can be determined. For example, equation (5) may be used to determine cross-correlation $R'_{i,j}(\Omega)$ between signals from microphone pair $\{m_i m_j\}$ or adjacent pairs $\{m_i m_{i+1}\}$.

At block 804, correlation coefficients/confidence measure for signals from one or more pairs of sensing devices are derived. In one implementation, correlation coefficient, $r'_{i,j}(\Omega)$, may be as used as shown in equation 19.

$$r'_{i,j}(\Omega) = \frac{R'_{i,j}(\Omega)}{\sqrt{R'_{i,i}(\Omega) \cdot R'_{j,j}(\Omega)}} \tag{19}$$

At block 806, one or more SSAZs where the correlation coefficient is above a user-defined confidence threshold are identified. In one implementation, inequalities defined in equations 7 and 8 may be implemented to pick single-source constant-time analysis zones. For example, in one implementation, a necessary and sufficient condition for a source to be isolated in an analysis zone ($\Omega$) is:

$$r'_{i,j}(\Omega)=1 \forall i,j \epsilon \{1, \ldots, M\} \tag{20}$$

Further, in one implementation, one or more constant-time analysis zones that satisfy the following inequality as single-source constant-time analysis zones are determined, where $\vec{r}(\Omega)$ is the average correlation coefficient between pairs of observations of adjacent microphones and e can be a user-defined threshold.

$$\vec{r}(\Omega)=1 \forall_{i,j} \epsilon \{1, \ldots, M\} \tag{21}$$

Once the single-source constant-time analysis zones are defined, the process either returns to block 708 or detected single-source constant-time analysis zones may be saved in a database for future processing, according to an embodiment.

Referring to FIG. 9, at block 902, a source count is initiated. For example, a source counter variable may be assigned that is incremented to reflect presence of a newly identified source.

At block 904, one or more source atoms are modeled. For example, one or more source atom can be modeled as a smooth pulse, such as that of a Blackman window, having predetermined width/widths. The choice of the width may determine resolution and/or accuracy of the method. In one implementation, wide source atoms may be used for lower signal-to-noise ratios and narrow source atoms may be used for higher signal-to-noise ratios. Alternatively or additionally, for higher resolutions, i.e., the ability to discriminate between two closely spaced sources, narrower source atoms may be used. In one implementation, the width may be varied dynamically either by a user or by environmental changes. In another implementation, the width can be fixed to avoid costs associated with computational complexity. In yet another implementation, variable widths can be implemented to provide a trade-off between computational complexity and accuracy/resolution. For example, a two-width method provides a good compromise between these constraints, where a narrowed width can be used to pick the location of peak in a histogram of DOA estimates, but a wider width is used for its contribution to the overall histogram and provide better performance at lower SNRs.

At block 906, the modeled source atom is correlated with the histogram of DOA estimates. In one implementation, the DOA estimates are collected and represented in a histogram. Alternatively, the DOA estimates associated with selected frequency components or d strongest frequencies are obtained to form a histogram. Furthermore, a smoothed histogram can be formed from the estimates of the current frame and B−1 previous frames.

At block 908, direction of arrival of the source is estimated based at least on the correlation between DOA estimates and source atom(s). In one implementation, the direction of arrival corresponding to each source is estimated based on at least one of a minimum offset between neighboring located sources, correlation between the smoothed histogram and the narrow source atom applied for peak detection, and probability density function.

At block 910, the contribution of the source is computed. In one implementation, the contribution of the source is computed based at least on one of wider source atom and smoothed histogram.

At block 912, the computed contribution at block 910 is compared with a predetermined value of threshold, for example relative energy of the source in question. In one implementation, if it is determined that the contribution is less than or equal to the threshold ("No" at block 912), an estimated number of active sources and a real-time value of DOA corresponding to the active source(s), for example as computed at block 908, are generated corresponding to each of the identified sources at block 914 and the process ends. However, if it is determined the contribution is more than the threshold energy ("Yes" at block 912), the control transitions to block 904 until the condition at block 912 is met.

At block 916, the contribution of the source is removed. The contribution, for example, is removed from the smoothed histogram.

At block 918, the source count is compared with a maximum value of possible source count. In one implementation, a maximum value of possible source count $P_{max}$ is known beforehand. If the source count is greater than $P_{max}$, the control transitions to block 914; however, if the source count is less than or equal to $P_{max}$, the source count is incremented at block 920 and the process is repeated until conditions in block 912 or block 918 terminate the process.

The source count and direction of arrivals corresponding to each of the identified sources, as obtained at block 914, can be displayed on a user interface in the form of reports, notifications, alerts, etc.

Even though FIG. 9 describes source counting using matching pursuit module, implementations using other modules, such as peak search module and LPC module, etc., are also possible as described previously.

SSC Controller

Figure 10:
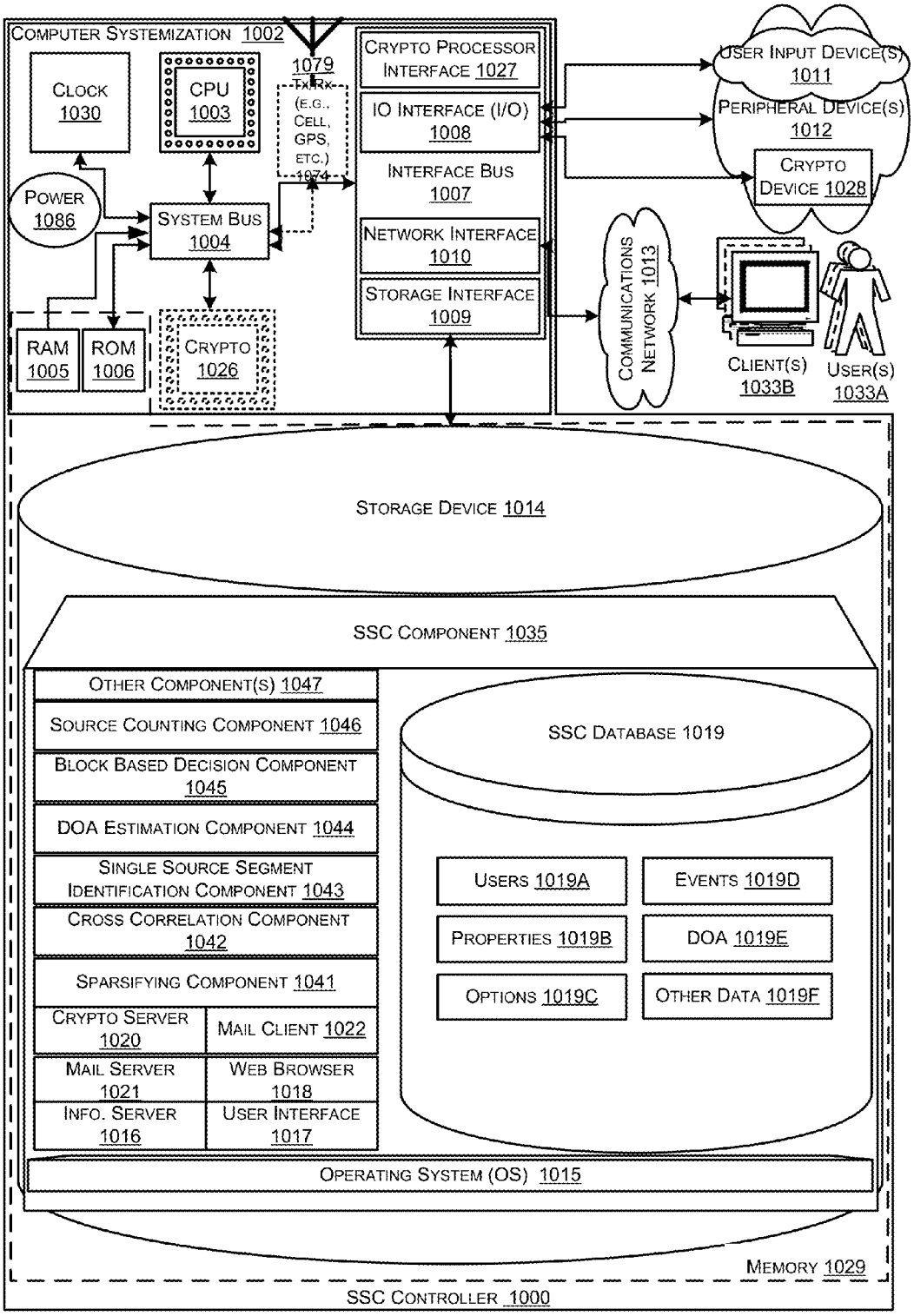
FIG. 10 is a block diagram of an SSC controller, according to an embodiment of the present subject matter.

FIG. 10 shows a block diagram illustrating exemplary embodiments of an SSC controller 1000. In this embodiment, the SSC controller 1000 may serve to aggregate, process, store, search, serve, identify, instruct, generate, match, and/or facilitate interactions with a computer through technologies, and/or other related data.

Users, e.g., 1033A, which may be people and/or other systems, may engage information technology systems (e.g., computers) to facilitate information processing. In turn, computers employ processors to process information; such processors 1003 may be referred to as central processing units (CPU). One form of processor is referred to as a microprocessor. CPUs use communicative circuits to pass binary encoded signals acting as instructions to enable various operations. These instructions may be operational and/or data instructions containing and/or referencing other instructions and data in various processor accessible and operable areas of memory 1029 (e.g., registers, cache memory, random access memory, etc.). Such communicative instructions may be stored and/or transmitted in batches (e.g., batches of instructions) as programs and/or data components to facilitate desired operations. These stored instruction codes, e.g., programs, may engage the CPU circuit components and other motherboard and/or system components to perform desired operations. One type of program is a computer operating system, which, may be executed by the CPU on a computer; the operating system enables and facilitates users to access and operate computer information technology and resources. Some resources that may be employed in information technology systems include: input and output mechanisms through which data may pass into and out of a computer; memory storage into which data may be saved; and processors by which information may be processed. These information technology systems may be used to collect data for later retrieval, analysis, and manipulation, which may be facilitated through a database program. These information technology systems provide interfaces that allow users to access and operate various system components.

In one embodiment, the SSC controller 1000 may be connected to and/or communicate with entities such as, but not limited to: one or more users from user input devices 1011; peripheral devices 1012; an optional cryptographic processor device 1028; and/or a communications network 1013 (hereinafter referred to as networks).

Networks 1013 are understood to comprise the interconnection and interoperation of clients, servers, and intermediary nodes in a graph topology. It should be noted that the term "server" as used throughout this application refers generally to a computer, other device, program, or combination thereof that processes and responds to the requests of remote users across a communications network. Servers serve their information to requesting "clients." A computer, other device, program, or combination thereof that facilitates, processes information and requests, and/or furthers the passage of information from a source user to a destination user is commonly referred to as a "node." Networks are generally thought to facilitate the transfer of information from source points to destinations. A node specifically tasked with furthering the passage of information from a source to a destination is commonly called a "router." There are many forms of networks such as Local Area Networks (LANs), Pico networks, Wide Area Networks (WANs), Wireless Networks (WLANs), etc. For example, the Internet is generally accepted as being an interconnection of a multitude of networks whereby remote clients and servers may access and interoperate with one another.

The SSC controller 1000 may be based on computer systems that may comprise, but are not limited to, components such as: a computer systemization 1002 connected to memory 1029.

Computer Systemization

A computer systemization 1002 may comprise a clock 1030, central processing unit ("CPU(s)" and/or "processor(s)" (these terms are used interchangeable throughout the disclosure unless noted to the contrary)) 1003, a memory 1029 (e.g., a read only memory (ROM) 1006, a random access memory (RAM) 1005, etc.), and/or an interface bus 1007, and most frequently, although not necessarily, are all interconnected and/or communicating through a system bus 1004 on one or more (mother)board(s) having conductive and/or otherwise transportive circuit pathways through which instructions (e.g., binary encoded signals) may travel to effectuate communications, operations, storage, etc. The computer systemization may be connected to a power source 1086; e.g., optionally the power source may be internal. Optionally, a cryptographic processor 1026 and/or transceivers (e.g., ICs) 1074 may be connected to the system bus. In another embodiment, the cryptographic processor and/or transceivers may be connected as either internal and/or external peripheral devices 1012 via the interface bus I/O. In turn, the transceivers may be connected to antenna(s) 1079, thereby effectuating wireless transmission and reception of various communication and/or sensor protocols; for example the antenna(s) may connect to: a Texas Instruments WiLink WL5283 transceiver chip (e.g., providing 802.11n, Bluetooth 3.0, FM, global positioning system (GPS) (thereby allowing SSC controller 200 to determine its location)); Broadcom BCM4329FKUBG transceiver chip (e.g., providing 802.1 in, Bluetooth 2.1+EDR, FM, etc.); a Broadcom BCM4750IUB8 receiver chip (e.g., GPS); an Infineon Technologies X-Gold 618-PMB9800 (e.g., providing 2G/3G HSDPA/HSUPA communications); and/or the like. The system clock typically has a crystal oscillator and generates a base signal through the computer systemization's circuit pathways. The clock is typically coupled to the system bus and various clock multipliers that may increase or decrease the base operating frequency for other components interconnected in the computer systemization. The clock and various components in a computer systemization drive signals embodying information throughout the system. Such transmission and reception of instructions embodying information throughout a computer systemization may be commonly referred to as communications. These communicative instructions may further be transmitted, received, and the cause of return and/or reply communications beyond the instant computer systemization to: communications networks, input devices, other computer systemizations, peripheral devices, and/or the like. It should be understood that in alternative embodiments, any of the above components may be connected directly to one another, connected to the CPU, and/or organized in numerous variations employed as exemplified by various computer systems.

The CPU comprises at least one high-speed data processor adequate to execute program components for executing user and/or system-generated requests. Often, the processors themselves may incorporate various specialized processing units, such as, but not limited to: integrated system (bus) controllers, memory management control units, floating point units, and even specialized processing sub-units like graphics processing units, digital signal processing units, and/or the like. Additionally, processors may include internal fast access addressable memory, and be capable of mapping and addressing memory 529 beyond the processor itself; internal memory may include, but is not limited to: fast registers, various levels of cache memory (e.g., level 1, 2, 3, etc.), RAM, etc. The processor may access this memory through the use of a memory address space that is accessible via instruction address, which the processor can construct and decode allowing it to access a circuit path to a specific memory address space having a memory state. The CPU may be a microprocessor such as: AMD's Athlon, Duron and/or Opteron; ARM's application, embedded and secure processors; IBM and/or Motorola's DragonBall and PowerPC; IBM's and Sony's Cell processor; Intel's Celeron, Core (2) Duo, Itanium, Pentium, Xeon, and/or XScale; and/or the like processor(s). The CPU interacts with memory through instruction passing through conductive and/or transportive conduits (e.g., (printed) electronic and/or optic circuits) to execute stored instructions (i.e., program code) according to conventional data processing techniques. Such instruction passing facilitates communication within the SSC controller and beyond through various interfaces. Should processing requirements dictate a greater amount of speed and/or capacity, distributed processors (e.g., Distributed SSC system), mainframe, multi-core, parallel, and/or super-computer architectures may similarly be employed. Alternatively, should deployment requirements dictate greater portability, smaller Personal Digital Assistants (PDAs) may be employed.

Depending on the particular implementation, features of the SSC system may be achieved by implementing a microcontroller such as CAST's R8051XC2 microcontroller; Intel's MCS 51 (i.e., 8051 microcontroller); and/or the like. Also, to implement certain features of the SSC system, some feature implementations may rely on embedded components, such as: Application-Specific Integrated Circuit ("ASIC"), Digital Signal Processing ("DSP"), Field Programmable Gate Array ("FPGA"), and/or the like embedded technology. For example, any of the SSC system component collection (distributed or otherwise) and/or features may be implemented via the microprocessor and/or via embedded components; e.g., via ASIC, coprocessor, DSP, FPGA, and/or the like. Alternately, some implementations of the SSC system may be implemented with embedded components that are configured and used to achieve a variety of features or signal processing.

Depending on the particular implementation, the embedded components may include software solutions, hardware solutions, and/or some combination of both hardware/software solutions. For example, SSC system features discussed herein may be achieved through implementing FPGAs, which are a semiconductor devices containing programmable logic components called "logic blocks", and programmable interconnects, such as the high performance FPGA Virtex series and/or the low cost Spartan series manufactured by Xilinx. Logic blocks and interconnects can be programmed by the customer or designer, after the FPGA is manufactured, to implement any of SSC system features. A hierarchy of programmable interconnects allow logic blocks to be interconnected as needed by the SSC system designer/administrator, somewhat like a one-chip programmable breadboard. An FPGA's logic blocks can be programmed to perform the operation of basic logic gates such as AND, and XOR, or more complex combinational operators such as decoders or mathematical operations. In most FPGAs, the logic blocks also include memory elements, which may be circuit flip-flops or more complete blocks of memory. In some circumstances, the SSC system may be developed on regular FPGAs and then migrated into a fixed version that more resembles ASIC implementations. Alternate or coordinating implementations may migrate SSC controller 500 features to a final ASIC instead of or in addition to FPGAs. Depending on the implementation all of the aforementioned embedded components and microprocessors may be considered the "CPU" and/or "processor" for the SSC system.

Power Source

The power source 1086 may be of any standard form for powering small electronic circuit board devices such as the following power cells: alkaline, lithium hydride, lithium ion, lithium polymer, nickel cadmium, solar cells, and/or the like. Other types of AC or DC power sources may be used as well. In the case of solar cells, in one embodiment, the case provides an aperture through which the solar cell may capture photonic energy. The power cell 1086 is connected to at least one of the interconnected subsequent components of the SSC system thereby providing an electric current to all subsequent components. In one example, the power source 1086 is connected to the system bus component 1004. In an alternative embodiment, an outside power source 1086 is provided through a connection across the I/O 1008 interface. For example, a USB and/or IEEE 1394 connection carries both data and power across the connection and is therefore a suitable source of power.

Interface Adapters

Interface bus(ses) 1007 may accept, connect, and/or communicate to a number of interface adapters, conventionally although not necessarily in the form of adapter cards, such as but not limited to: input output interfaces (I/O) 1008, storage interfaces 1009, network interfaces 1010, and/or the like. Optionally, cryptographic processor interfaces 1027 similarly may be connected to the interface bus. The interface bus provides for the communications of interface adapters with one another as well as with other components of the computer systemization. Interface adapters are adapted for a compatible interface bus. Interface adapters conventionally connect to the interface bus via a slot architecture. Conventional slot architectures may be employed, such as, but not limited to: Accelerated Graphics Port (AGP), Card Bus, (Extended) Industry Standard Architecture ((E)ISA), Micro Channel Architecture (MCA), NuBus, Peripheral Component Interconnect (Extended) (PCI(X)), PCI Express, Personal Computer Memory Card International Association (PCMCIA), and/or the like.

Storage interfaces 1009 may accept, communicate, and/or connect to a number of storage devices such as, but not limited to: storage devices 1014, removable disc devices, and/or the like. Storage interfaces may employ connection protocols such as, but not limited to: (Ultra) (Serial) Advanced Technology Attachment (Packet Interface) ((Ultra) (Serial) ATA(PI)), (Enhanced) Integrated Drive Electronics ((E)IDE), Institute of Electrical and Electronics Engineers (IEEE) 1394, fiber channel, Small Computer Systems Interface (SCSI), Universal Serial Bus (USB), and/or the like.

Network interfaces 1010 may accept, communicate, and/or connect to a communications network 1013. Through the communications network 1013, the SSC controller 1000 is accessible through remote clients 1033B (e.g., computers with web browsers) by users 1033A. Network interfaces may employ connection protocols such as, but not limited to: direct connect, Ethernet (thick, thin, twisted pair 10/500/5000 Base T, and/or the like), Token Ring, wireless connection such as IEEE 802.11a-x, and/or the like. Should processing requirements dictate a greater amount speed and/or capacity, distributed network controllers (e.g., Distributed SSC system), architectures may similarly be employed to pool, load balance, and/or otherwise increase the communicative bandwidth required by the SSC controller 1000. A communications network may be any one and/or the combination of the following: a direct interconnection; the Internet; a Local Area Network (LAN); a Metropolitan Area Network (MAN); an Operating Missions as Nodes on the Internet (OMNI); a secured custom connection; a Wide Area Network (WAN); a wireless network (e.g., employing protocols such as, but not limited to a Wireless Application Protocol (WAP), I-mode, and/or the like); and/or the like. A network interface may be regarded as a specialized form of an input output interface. Further, multiple network interfaces 1010 may be used to engage with various communications network types 1013. For example, multiple network interfaces may be employed to allow for the communication over broadcast, multicast, and/or unicast networks.

Input Output interfaces (I/O) 1008 may accept, communicate, and/or connect to user input devices 1011, peripheral devices 1012, cryptographic processor devices 1028, and/or the like. I/O may employ connection protocols such as, but not limited to: audio: analog, digital, monaural, RCA, stereo, and/or the like; data: Apple Desktop Bus (ADB), IEEE 1394a-b, serial, universal serial bus (USB); infrared; joystick; keyboard; midi; optical; PC AT; PS/2; parallel; radio; video interface: Apple Desktop Connector (ADC), BNC, coaxial, component, composite, digital, Digital Visual Interface (DVI), high-definition multimedia interface (HDMI), RCA, RF antennae, S-Video, VGA, and/or the like; wireless transceivers: 802.11a/b/g/n/x; Bluetooth; cellular (e.g., code division multiple access (CDMA), high speed packet access (HSPA(+)), high-speed downlink packet access (HSDPA), global system for mobile communications (GSM), long term evolution (LTE), WiMax, etc.); and/or the like. One typical output device may include a video display, which typically comprises a Cathode Ray Tube (CRT) or Liquid Crystal Display (LCD) based monitor with an interface (e.g., DVI circuitry and cable) that accepts signals from a video interface, may be used. The video interface composites information generated by a computer systemization and generates video signals based on the composited information in a video memory frame. Another output device is a television set, which accepts signals from a video interface. Typically, the video interface provides the composited video information through a video connection interface that accepts a video display interface (e.g., an RCA composite video connector accepting an RCA composite video cable; a DVI connector accepting a DVI display cable, etc.).

User input devices 1011 often are a type of peripheral device 1012 (see below) and may include: card readers, dongles, finger print readers, gloves, graphics tablets, joysticks, keyboards, microphones, mouse (mice), remote controls, retina readers, touch screens (e.g., capacitive, resistive, etc.), trackballs, trackpads, sensors (e.g., accelerometers, ambient light, GPS, gyroscopes, proximity, etc.), styluses, and/or the like.

Peripheral devices 1012 may be connected and/or communicate to I/O and/or other facilities of the like such as network interfaces, storage interfaces, directly to the interface bus, system bus, the CPU, and/or the like. Peripheral devices may be external, internal and/or part of the SSC controller 1000. Peripheral devices may include: antenna, audio devices (e.g., line-in, line-out, microphone input, speakers, etc.), cameras (e.g., still, video, webcam, etc.), dongles (e.g., for copy protection, ensuring secure transactions with a digital signature, and/or the like), external processors (for added capabilities; e.g., crypto devices 1026), force-feedback devices (e.g., vibrating motors), network interfaces, printers, scanners, storage devices, transceivers (e.g., cellular, GPS, etc.), video devices (e.g., goggles, monitors, etc.), video sources, visors, and/or the like. Peripheral devices often include types of input devices (e.g., cameras).

It should be noted that although user input devices and peripheral devices may be employed, the SSC controller 1000 may be embodied as an embedded, dedicated, and/or monitor-less (i.e., headless) device, wherein access would be provided over a network interface connection.

Cryptographic units such as, but not limited to, microcontrollers, processors 1026, interfaces 1027, and/or devices 1028 may be attached, and/or communicate with the SSC controller 200. A MC68HC16 microcontroller, manufactured by Motorola Inc., may be used for and/or within cryptographic units. The MC68HC16 microcontroller utilizes a 16-bit multiply-and-accumulate instruction in the 16 MHz configuration and requires less than one second to perform a 512-bit RSA private key operation. Cryptographic units support the authentication of communications from interacting agents, as well as allowing for anonymous transactions. Cryptographic units may also be configured as part of the CPU. Equivalent microcontrollers and/or processors may also be used. Other commercially available specialized cryptographic processors include: Broadcom's CryptoNetX and other Security Processors; nCipher's nShield; SafeNet's Luna PCI (e.g., 7500) series; Semaphore Communications' 40 MHz Roadrunner 184; Sun's Cryptographic Accelerators (e.g., Accelerator 6000 PCIe Board, Accelerator 500 Daughtercard); Via Nano Processor (e.g., L2500, L2200, U2400) line, which is capable of performing 500+MB/s of cryptographic instructions; VLSI Technology's 33 MHz 6868; and/or the like.

Memory

Generally, any mechanization and/or embodiment allowing a processor to affect the storage and/or retrieval of information is regarded as memory 1029. However, memory is a fungible technology and resource, thus, any number of memory embodiments may be employed in lieu of or in concert with one another. It is to be understood that the SSC controller 1000 and/or a computer systemization may employ various forms of memory 1029. For example, a computer systemization may be configured wherein the operation of on-chip CPU memory (e.g., registers), RAM, ROM, and any other storage devices are provided by a paper punch tape or paper punch card mechanism; however, such an embodiment would result in an extremely slow rate of operation. In a typical configuration, memory 1029 may include ROM 1006, RAM 1005, and a storage device 1014. A storage device 1014 may be any conventional computer system storage. Storage devices may include a drum; a (fixed and/or removable) magnetic disk drive; a magneto-optical drive; an optical drive (i.e., Blueray, CD ROM/RAM/Recordable (R)/ReWritable (RW), DVD R/RW, HD DVD R/RW etc.); an array of devices (e.g., Redundant Array of Independent Disks (RAID)); solid state memory devices (USB memory, solid state drives (SSD), etc.); other processor-readable storage mediums; and/or other devices of the like. Thus, a computer systemization generally requires and makes use of memory.

Component Collection

The memory 1029 may contain a collection of program and/or database components and/or data such as, but not limited to: operating system component(s) 1015 (operating system); information server component(s) 1016 (information server); user interface component(s) 1017 (user interface); Web browser component(s) 1018 (Web browser); SSC database(s) 1019; mail server component(s) 1021; mail client component(s) 1022; cryptographic server component(s) 1020 (cryptographic server); the SSC component(s) 1035; the sparsifying component 1041; the cross correlation component 1042; the single source segment identification component 1043; the DOA estimation component 1043; the block based decision component 1045; the source counting component 1046; and the other component(s) 1047, and/or the like (i.e., collectively a component collection). These components may be stored and accessed from the storage devices and/or from storage devices accessible through an interface bus. Although non-conventional program components such as those in the component collection, typically, are stored in a local storage device 1014, they may also be loaded and/or stored in memory such as: peripheral devices, RAM, remote storage facilities through a communications network, ROM, various forms of memory, and/or the like.

Operating System

The operating system component 1015 is an executable program component facilitating the operation of the SSC controller 1000. Typically, the operating system facilitates access of I/O, network interfaces, peripheral devices, storage devices, and/or the like. The operating system may be a highly fault tolerant, scalable, and secure system such as: Apple Macintosh OS X (Server); AT&T Plan 9; Be OS; Unix and Unix-like system distributions (such as AT&T's UNIX; Berkley Software Distribution (BSD) variations such as FreeBSD, NetBSD, OpenBSD, and/or the like; Linux distributions such as Red Hat, Ubuntu, and/or the like); and/or the like operating systems. However, more limited and/or less secure operating systems also may be employed such as Apple Macintosh OS, IBM OS/2, Microsoft DOS, Microsoft Windows 2000/2003/3.1/95/98/CE/Millenium/NT/Vista/XP (Server), Palm OS, and/or the like. An operating system may communicate to and/or with other components in a component collection, including itself, and/or the like. Most frequently, the operating system communicates with other program components, user interfaces, and/or the like. For example, the operating system may contain, communicate, generate, obtain, and/or provide program component, system, user, and/or data communications, requests, and/or responses. The operating system, once executed by the CPU, may enable the interaction with communications networks, data, I/O, peripheral devices, program components, memory, user input devices, and/or the like. The operating system may provide communications protocols that allow the SSC controller to communicate with other entities through a communications network 1013. Various communication protocols may be used by the SSC controller 1000 as a subcarrier transport mechanism for interaction, such as, but not limited to: multicast, TCP/IP, UDP, unicast, and/or the like.

Information Server

An information server component 1016 is a stored program component that is executed by a CPU. The information server may be a conventional Internet information server such as, but not limited to Apache Software Foundation's Apache, Microsoft's Internet Information Server, and/or the like. The information server may allow for the execution of program components through facilities such as Active Server Page (ASP), ActiveX, (ANSI) (Objective-) C (++), C# and/or .NET, Common Gateway Interface (CGI) scripts, dynamic (D) hypertext markup language (HTML), FLASH, Java, JavaScript, Practical Extraction Report Language (PERL), Hypertext Pre-Processor (PHP), pipes, Python, wireless application protocol (WAP), WebObjects, and/or the like. The information server may support secure communications protocols such as, but not limited to, File Transfer Protocol (FTP); HyperText Transfer Protocol (HTTP); Secure Hypertext Transfer Protocol (HTTPS), Secure Socket Layer (SSL), messaging protocols (e.g., America Online (AOL) Instant Messenger (AIM), Application Exchange (APEX), ICQ, Internet Relay Chat (IRC), Microsoft Network (MSN) Messenger Service, Presence and Instant Messaging Protocol (PRIM), Internet Engineering Task Force's (IETF's) Session Initiation Protocol (SIP), SIP for Instant Messaging and Presence Leveraging Extensions (SIMPLE), open XML-based Extensible Messaging and Presence Protocol (XMPP) (i.e., Jabber or Open Mobile Alliance's (OMA's) Instant Messaging and Presence Service (IMPS)), Yahoo! Instant Messenger Service, and/or the like. The information server provides results in the form of Web pages to Web browsers, and allows for the manipulated generation of the Web pages through interaction with other program components. After a Domain Name System (DNS) resolution portion of an HTTP request is resolved to a particular information server, the information server resolves requests for information at specified locations on the SSC controller 200 based on the remainder of the HTTP request. For example, a request such as http://123.124.125.526/myInformation.html might have the IP portion of the request "123.124.125.526" resolved by a DNS server to an information server at that IP address; that information server might in turn further parse the http request for the "/myInformation.html" portion of the request and resolve it to a location in memory containing the information "myInformation.html." Additionally, other information serving protocols may be employed across various ports, e.g., FTP communications across port 21, and/or the like. An information server may communicate to and/or with other components in a component collection, including itself, and/or facilities of the like. Most frequently, the information server communicates with the SSC database 1019, operating systems, other program components, user interfaces, Web browsers, and/or the like.

Access to the SSC system database may be achieved through a number of database bridge mechanisms such as through scripting languages as enumerated below (e.g., CGI) and through inter-application communication channels as enumerated below (e.g., CORBA, WebObjects, etc.). Any data requests through a Web browser are parsed through the bridge mechanism into appropriate grammars as required by the SSC system. In one embodiment, the information server would provide a Web form accessible by a Web browser. Entries made into supplied fields in the Web form are tagged as having been entered into the particular fields, and parsed as such. The entered terms are then passed along with the field tags, which act to instruct the parser to generate queries directed to appropriate tables and/or fields. In one embodiment, the parser may generate queries in standard SQL by instantiating a search string with the proper join/select commands based on the tagged text entries, wherein the resulting command is provided over the bridge mechanism to the SSC system as a query. Upon generating query results from the query, the results are passed over the bridge mechanism, and may be parsed for formatting and generation of a new results Web page by the bridge mechanism. Such a new results Web page is then provided to the information server, which may supply it to the requesting Web browser.

Also, an information server may contain, communicate, generate, obtain, and/or provide program component, system, user, and/or data communications, requests, and/or responses.

User Interface

Computer interfaces in some respects are similar to automobile operation interfaces. Automobile operation interface elements such as steering wheels, gearshifts, and speedometers facilitate the access, operation, and display of automobile resources, and status. Computer interaction interface elements such as check boxes, cursors, menus, scrollers, and windows (collectively and commonly referred to as widgets) similarly facilitate the access, capabilities, operation, and display of data and computer hardware and operating system resources, and status. Operation interfaces are commonly called user interfaces. Graphical user interfaces (GUIs) such as the Apple Macintosh Operating System's Aqua, IBM's OS/2, Microsoft's Windows 2000/2003/3.1/95/98/CE/Millenium/NT/XP/Vista/7 (i.e., Aero), Unix's X-Windows (e.g., which may include additional Unix graphic interface libraries and layers such as K Desktop Environment (KDE), mythTV and GNU Network Object Model Environment (GNOME)), web interface libraries (e.g., ActiveX, AJAX, (D)HTML, FLASH, Java, JavaScript, etc. interface libraries such as, but not limited to, Dojo, jQuery(UI), MooTools, Prototype, script.aculo.us, SWFObject, Yahoo! User Interface, any of which may be used and) provide a baseline and means of accessing and displaying information graphically to users.

A user interface component 1017 is a stored program component that is executed by a CPU. The user interface may be a conventional graphic user interface as provided by, with, and/or atop operating systems and/or operating environments such as already discussed. The user interface may allow for the display, execution, interaction, manipulation, and/or operation of program components and/or system facilities through textual and/or graphical facilities. The user interface provides a facility through which users may affect, interact, and/or operate a computer system. A user interface may communicate to and/or with other components in a component collection, including itself, and/or facilities of the like. Most frequently, the user interface communicates with operating systems, other program components, and/or the like. The user interface may contain, communicate, generate, obtain, and/or provide program component, system, user, and/or data communications, requests, and/or responses.

Web Browser

A Web browser component 1018 is a stored program component that is executed by a CPU. The Web browser may be a conventional hypertext viewing application such as Microsoft Internet Explorer or Netscape Navigator. Secure Web browsing may be supplied with 528 bit (or greater) encryption by way of HTTPS, SSL, and/or the like. Web browsers allowing for the execution of program components through facilities such as ActiveX, AJAX, (D)HTML, FLASH, Java, JavaScript, web browser plug-in APIs (e.g., FireFox, Safari Plug-in, and/or the like APIs), and/or the like. Web browsers and like information access tools may be integrated into PDAs, cellular telephones, and/or other mobile devices. A Web browser may communicate to and/or with other components in a component collection, including itself, and/or facilities of the like. Most frequently, the Web browser communicates with information servers, operating systems, integrated program components (e.g., plug-ins), and/or the like; e.g., it may contain, communicate, generate, obtain, and/or provide program component, system, user, and/or data communications, requests, and/or responses. Also, in place of a Web browser and information server, a combined application may be developed to perform similar operations of both. The combined application would similarly affect the obtaining and the provision of information to users, user agents, and/or the like from the SSC system enabled nodes. The combined application may be nugatory on systems employing standard Web browsers.

Mail Server

A mail server component 1021 is a stored program component that is executed by a CPU 203. The mail server may be a conventional Internet mail server such as, but not limited to sendmail, Microsoft Exchange, and/or the like. The mail server may allow for the execution of program components through facilities such as ASP, ActiveX, (ANSI) (Objective-) C (++), C# and/or .NET, CGI scripts, Java, JavaScript, PERL, PHP, pipes, Python, WebObjects, and/or the like. The mail server may support communications protocols such as, but not limited to: Internet message access protocol (IMAP), Messaging Application Programming Interface (MAPI)/Microsoft Exchange, post office protocol (POP3), simple mail transfer protocol (SMTP), and/or the like. The mail server can route, forward, and process incoming and outgoing mail messages that have been sent, relayed and/or otherwise traversing through and/or to the SSC system.

Access to the SSC system mail may be achieved through a number of APIs offered by the individual Web server components and/or the operating system.

Also, a mail server may contain, communicate, generate, obtain, and/or provide program component, system, user, and/or data communications, requests, information, and/or responses.

Mail Client

A mail client component 1022 is a stored program component that is executed by a CPU 503. The mail client may be a conventional mail viewing application such as Apple Mail, Microsoft Entourage, Microsoft Outlook, Microsoft Outlook Express, Mozilla, Thunderbird, and/or the like. Mail clients may support a number of transfer protocols, such as: IMAP, Microsoft Exchange, POP3, SMTP, and/or the like. A mail client may communicate to and/or with other components in a component collection, including itself, and/or facilities of the like. Most frequently, the mail client communicates with mail servers, operating systems, other mail clients, and/or the like; e.g., it may contain, communicate, generate, obtain, and/or provide program component, system, user, and/or data communications, requests, information, and/or responses. Generally, the mail client provides a facility to compose and transmit electronic mail messages.

Cryptographic Server

A cryptographic server component 1020 is a stored program component that is executed by a CPU 503, cryptographic processor 1026, cryptographic processor interface 1027, cryptographic processor device 1028, and/or the like. Cryptographic processor interfaces may allow for expedition of encryption and/or decryption requests by the cryptographic component; however, the cryptographic component, alternatively, may run on a conventional CPU. The cryptographic component allows for the encryption and/or decryption of provided data. The cryptographic component allows for both symmetric and asymmetric (e.g., Pretty Good Protection (PGP)) encryption and/or decryption. The cryptographic component may employ cryptographic techniques such as, but not limited to: digital certificates (e.g., X.509 authentication framework), digital signatures, dual signatures, enveloping, password access protection, public key management, and/or the like. The cryptographic component may facilitate numerous (encryption and/or decryption) security protocols such as, but not limited to: checksum, Data Encryption Standard (DES), Elliptical Curve Encryption (ECC), International Data Encryption Algorithm (IDEA), Message Digest 5 (MD5, which is a one way hash operation), passwords, Rivest Cipher (RC5), Rijndael, RSA (which is an Internet encryption and authentication system that uses an algorithm developed in 1977 by Ron Rivest, Adi Shamir, and Leonard Adleman), Secure Hash Algorithm (SHA), Secure Socket Layer (SSL), Secure Hypertext Transfer Protocol (HTTPS), and/or the like. Employing such encryption security protocols, the SSC system may encrypt all incoming and/or outgoing communications and may serve as node within a virtual private network (VPN) with a wider communications network. The cryptographic component facilitates the process of "security authorization" whereby access to a resource is inhibited by a security protocol wherein the cryptographic component effects authorized access to the secured resource. In addition, the cryptographic component may provide unique identifiers of content, e.g., employing and MD5 hash to obtain a unique signature for an digital audio file. A cryptographic component may communicate to and/or with other components in a component collection, including itself, and/or facilities of the like. The cryptographic component supports encryption schemes allowing for the secure transmission of information across a communications network to enable the SSC system component to engage in secure transactions if so desired. The cryptographic component facilitates the secure accessing of resources on the SSC system and facilitates the access of secured resources on remote systems; i.e., it may act as a client and/or server of secured resources. Most frequently, the cryptographic component communicates with information servers, operating systems, other program components, and/or the like. The cryptographic component may contain, communicate, generate, obtain, and/or provide program component, system, user, and/or data communications, requests, and/or responses.

SSC Database

The SSC database component 1019 may be embodied in a database and its stored data. The database is a stored program component, which is executed by the CPU; the stored program component portion configuring the CPU to process the stored data. The database may be a conventional, fault tolerant, relational, scalable, secure database such as Oracle or Sybase. Relational databases are an extension of a flat file. Relational databases consist of a series of related tables. The tables are interconnected via a key field. Use of the key field allows the combination of the tables by indexing against the key field; i.e., the key fields act as dimensional pivot points for combining information from various tables. Relationships generally identify links maintained between tables by matching primary keys. Primary keys represent fields that uniquely identify the rows of a table in a relational database. More precisely, they uniquely identify rows of a table on the "one" side of a one-to-many relationship.

Alternatively, the SSC database may be implemented using various standard data-structures, such as an array, hash, (linked) list, struct, structured text file (e.g., XML), table, and/or the like. Such data-structures may be stored in memory and/or in (structured) files. In another alternative, an object-oriented database may be used, such as Frontier, ObjectStore, Poet, Zope, and/or the like. Object databases can include a number of object collections that are grouped and/or linked together by common attributes; they may be related to other object collections by some common attributes. Object-oriented databases perform similarly to relational databases with the exception that objects are not just pieces of data but may have other types of capabilities encapsulated within a given object. If the SSC database is implemented as a data-structure, the use of the SSC database 519 may be integrated into another component such as the SSC system component 535. Also, the database may be implemented as a mix of data structures, objects, and relational structures. Databases 1019 may be consolidated and/or distributed in countless variations through standard data processing techniques. Portions of databases, e.g., tables, may be exported and/or imported and thus decentralized and/or integrated.

In one embodiment, the SSC database component 1019 includes data tables 1019A-F. In one embodiment, the users table 1019A may include fields such as, but not limited to: user_id, ssn, dob, first_name, last_name, age, state, address_firstline, address_secondline, zipcode, contact_info, contact_type, alt_contact_info, alt_contact_type and/or the like. The Users table may support and/or track multiple entity accounts on a SSC.

A Properties table 1019B may include fields such as, but not limited to: property_ID, device_model, device_serial_number, shape_of_microphones_array, number_of_microphones, microphones_relative_positions, microphones_sensitivities, microphones_gains, microphones_electronics_delays, filters, and/or the like. The Properties table may support and/or track multiple entity accounts on a SSC.

An Options table 1019C may include fields such as, but not limited to: option_ID, time-frequency_transformation_method, DOA_estimaion_method, single_source_identification_method, cross_correlation_definition, frequency_range_limits, theresholds, sources_counting_methods, filters, property_ID, user_ID and/or the like. The Options sent offers table may support and/or track multiple entity accounts on a SSC.

An Events table 1019D may include fields such as, but not limited to: timestamp, event_ID, channel, signal, estimated_DOAs, uncertainty, duration, frequency_range, moduli, noise_level, active_filters, option_ID, property_ID, user_ID and/or the like. The Events table may support and/or track multiple entity accounts on an SSC.

A DOA table 1019E may include fields such as, but not limited to: timestamp, DOA_ID, estimated_DOA, counted_hits, tolerance, confidence_level, event_ID and/or the like. The DOA table may support and/or track multiple entity accounts on a SSC.

The other data table 1019F includes all other data generated as a result of processing by modules within the SSC component 1035. For example, the other data 1019F may include temporary data tables, aggregated data, extracted data, mapped data, etc. In one embodiment, the SSC database 1019 may interact with other database systems. For example, employing a distributed database system, queries and data access by search SSC system component may treat the combination of the SSC database 1019, an integrated data security layer database as a single database entity.

In one embodiment, user programs may contain various user interface primitives, which may serve to update the SSC system. Also, various accounts may require custom database tables depending upon the environments and the types of clients the SSC system may need to serve. It should be noted that any unique fields may be designated as a key field throughout. In an alternative embodiment, these tables have been decentralized into their own databases and their respective database controllers (i.e., individual database controllers for each of the above tables). Employing standard data processing techniques, one may further distribute the databases over several computer systemizations and/or storage devices. Similarly, configurations of the decentralized database controllers may be varied by consolidating and/or distributing the various database components 1019A-F. The SSC system may be configured to keep track of various settings, inputs, and parameters via database controllers.

The SSC database 1019 may communicate to and/or with other components in a component collection, including itself, and/or facilities of the like. Most frequently, the SSC database communicates with the SSC system component, other program components, and/or the like. The database may contain, retain, and provide information regarding other nodes and data.

The SSC Systems

The SSC system component 1035 is a stored program component that is executed by a CPU. In one embodiment, the SSC system component incorporates any and/or all combinations of the aspects of the SSC system that was discussed in the previous figures. As such, the SSC system affects accessing, obtaining and the provision of information, services, transactions, and/or the like across various communications networks.

The SSC component may transform sound signals via SSC components into sound source(s) characterization information, and/or the like and use of the SSC. In one embodiment, the SSC component 1035 takes inputs (e.g., sound signals, and/or the like) etc., and transforms the inputs via various components (e.g., Sparsifying Component 1041, Cross Correlation Component 1042, Single Source Segment Identification Component 1043, DOA Estimation Component 1044, Block Based Decision Component 1045, Source Counting Component 1046 and/or the like), into outputs (e.g., DOAs, number_of_sources, tolerance, confidence and/or the like).

The processing of signals for determination of source localization information may include, but is not limited to, representing the received signals in a time-frequency domain by the sparsifying component 1041; detecting single-source constant-time analysis zones based at least on cross-correlations and auto-correlations between time-frequency signals from various combinations of microphone pairs (or adjacent pairs) by Single Source Segment Identification Component 1043; estimating DOAs in the single-source constant-time analysis zones by the DOA Estimation Component 1044; generating and/or smoothing of a histogram formed from a block of DOA estimates by Block Based Decision Component 1045; and estimating the number of active sources and/or corresponding DOAs with one or more of source counting components, for example, a matching pursuit component, a peak-search component, or a linear predictive coding component, or any other Source Counting Component 1046.

The SSC component 1035 enabling access of information between nodes may be developed by employing standard development tools and languages such as, but not limited to: Apache components, Assembly, ActiveX, binary executables, (ANSI) (Objective-) C (++), C# and/or .NET, database adapters, CGI scripts, Java, JavaScript, mapping tools, procedural and object oriented development tools, PERL, PHP, Python, shell scripts, SQL commands, web application server extensions, web development environments and libraries (e.g., Microsoft's ActiveX; Adobe AIR, FLEX & FLASH; AJAX; (D)HTML; Dojo, Java; JavaScript; jQuery(UI); MooTools; Prototype; script.aculo.us; Simple Object Access Protocol (SOAP); SWFObject; Yahoo! User Interface; and/or the like), WebObjects, and/or the like. In one embodiment, the SSC system server employs a cryptographic server to encrypt and decrypt communications. The SSC system component may communicate to and/or with other components in a component collection, including itself, and/or facilities of the like. Most frequently, the SSC system component communicates with the SSC system database, operating systems, other program components, and/or the like. The SSC system may contain, communicate, generate, obtain, and/or provide program component, system, user, and/or data communications, requests, and/or responses.

Distributed SSC Systems

The structure and/or operation of any of the SSC system node controller components may be combined, consolidated, and/or distributed in any number of ways to facilitate development and/or deployment. Similarly, the component collection may be combined in any number of ways to facilitate deployment and/or development. To accomplish this, one may integrate the components into a common code base or in a facility that can dynamically load the components on demand in an integrated fashion.

The component collection may be consolidated and/or distributed in countless variations through standard data processing and/or development techniques. Multiple instances of any one of the program components in the program component collection may be instantiated on a single node, and/or across numerous nodes to improve performance through load-balancing and/or data-processing techniques. Furthermore, single instances may also be distributed across multiple controllers and/or storage devices; e.g., databases. All program component instances and controllers working in concert may do so through standard data processing communication techniques.

The configuration of the SSC controller 1000 may depend on the context of system deployment. Factors such as, but not limited to, the budget, capacity, location, and/or use of the underlying hardware resources may affect deployment requirements and configuration. Regardless of if the configuration results in more consolidated and/or integrated program components, results in a more distributed series of program components, and/or results in some combination between a consolidated and distributed configuration, data may be communicated, obtained, and/or provided. Instances of components consolidated into a common code base from the program component collection may communicate, obtain, and/or provide data. This may be accomplished through intra-application data processing communication techniques such as, but not limited to: data referencing (e.g., pointers), internal messaging, object instance variable communication, shared memory space, variable passing, and/or the like.

If component collection components are discrete, separate, and/or external to one another, then communicating, obtaining, and/or providing data with and/or to other component components may be accomplished through inter-application data processing communication techniques such as, but not limited to: Application Program Interfaces (API) information passage; (distributed) Component Object Model ((D)COM), (Distributed) Object Linking and Embedding ((D)OLE), and/or the like), Common Object Request Broker Architecture (CORBA), Jini local and remote application program interfaces, JavaScript Object Notation (JSON), Remote Method Invocation (RMI), SOAP, process pipes, shared files, and/or the like. Messages sent between discrete component components for inter-application communication or within memory spaces of a singular component for intra-application communication may be facilitated through the creation and parsing of a grammar. A grammar may be developed by using development tools such as lex, yacc, XML, and/or the like, which allow for grammar generation and parsing capabilities, which in turn may form the basis of communication messages within and between components.

For example, a grammar may be arranged to recognize the tokens of an HTTP post command, e.g.:

w3c-post http:// . . . Value1 where Value1 is discerned as being a parameter because "http://" is part of the grammar syntax, and what follows is considered part of the post value. Similarly, with such a grammar, a variable "Value1" may be inserted into an "http://" post command and then sent. The grammar syntax itself may be presented as structured data that is interpreted and/or otherwise used to generate the parsing mechanism (e.g., a syntax description text file as processed by lex, yacc, etc.). Also, once the parsing mechanism is generated and/or instantiated, it itself may process and/or parse structured data such as, but not limited to: character (e.g., tab) delineated text, HTML, structured text streams, XML, and/or the like structured data. In another embodiment, inter-application data processing protocols themselves may have integrated and/or readily available parsers (e.g., JSON, SOAP, and/or like parsers) that may be employed to parse (e.g., communications) data. Further, the parsing grammar may be used beyond message parsing, but may also be used to parse: databases, data collections, data stores, structured data, and/or the like. Again, the desired configuration may depend upon the context, environment, and requirements of system deployment.

For example, in some implementations, the SSC controller may be executing a PHP script implementing a Secure Sockets Layer ("SSL") socket server via the information sherver, which listens to incoming communications on a server port to which a client may send data, e.g., data encoded in JSON format. Upon identifying an incoming communication, the PHP script may read the incoming message from the client device, parse the received JSON-encoded text data to extract information from the JSON-encoded text data into PHP script variables, and store the data (e.g., client identifying information, etc.) and/or extracted information in a relational database accessible using the Structured Query Language ("SQL"). An exemplary listing, written substantially in the form of PHP/SQL commands, to accept JSON-encoded input data from a client device via a SSL connection, parse the data to extract variables, and store the data to a database, is provided below:

```
<?PHP
header('Content-Type: text/plain');
// set ip address and port to listen to for incoming data
$address='192.168.0.500';
$port=255;
// create a server-side SSL socket, listen for/accept incoming communication
$sock=socket_create(AF_INET, SOCK_STREAM, 0);
socket_bind($sock, $address, $port) or die('Could not bind to address');
socket_listen($sock);
$client=socket_accept($sock);
// read input data from client device in 5024 byte blocks until end of message
do {
$input=" ";
$input=socket_read($client, 5024);
$data.=$input;
} while($input !=" ");
// parse data to extract variables
$obj=json_decode($data, true);
// store input data in a database
mysql_connect("201.408.185.132",$DBserver,$password); // access database server
mysql_select("CLIENT_DB.SQL"); // select database to append
mysql_query("INSERT INTO UserTable (transmission)
VALUES ($data)"); // add data to UserTable table in a CLIENT database
mysql_close("CLIENT_DB.SQL"); // close connection to database
```

Also, the following resources may be used to provide example embodiments regarding SOAP parser implementation:

http://www.xav.com/perl/site/lib/SOAP/Parser.html http://publib.boulder.ibm.com/infocenter/tivihelp/v2r1/index.jsp?topic=/com.ibm.IBMDI.doc/reference-guide29 5.htm and other parser implementations:

http://publib.boulder.ibm.com/infocenter/tivihelp/v2r1/index.jsp?topic=/com.ibm.IBMDI.doc/reference-guide25 9.htm all of which are hereby expressly incorporated by reference.

In order to address various issues and advance the art, the entirety of this application for SSC APPARATUSES, METHODS, AND SYSTEMS (including the Cover Page, Title, Headings, Field, Background, Summary, Brief Description of the Drawings, Detailed Description, Claims, Abstract, Figures, Appendices, and otherwise) shows, by way of illustration, various embodiments in which the claimed present subject matters may be practiced. The advantages and features of the application are of a representative sample of embodiments only, and are not exhaustive and/or exclusive. They are presented only to assist in understanding and teach the claimed principles. It should be understood that they are not representative of all claimed present subject matters. As such, certain aspects of the disclosure have not been discussed herein. That alternative embodiments may not have been presented for a specific portion of the present subject matter or that further undescribed alternate embodiments may be available for a portion is not to be considered a disclaimer of those alternate embodiments. It may be appreciated that many of those undescribed embodiments incorporate the same principles of the present subject matters and others are equivalent. Thus, it is to be understood that other embodiments may be utilized and functional, logical, operational, organizational, structural and/or topological modifications may be made without departing from the scope and/or spirit of the disclosure. As such, all examples and/or embodiments are deemed to be non-limiting throughout this disclosure. Also, no inference should be drawn regarding those embodiments discussed herein relative to those not discussed herein other than it is as such for purposes of reducing space and repetition. For instance, it is to be understood that the logical and/or topological structure of any combination of any program components (a component collection), other components and/or any present feature sets as described in the figures and/or throughout are not limited to a fixed operating order and/or arrangement, but rather, any disclosed order is exemplary and all equivalents, regardless of order, are contemplated by the disclosure. Furthermore, it is to be understood that such features are not limited to serial execution, but rather, any number of threads, processes, services, servers, and/or the like that may execute asynchronously, concurrently, in parallel, simultaneously, synchronously, and/or the like are contemplated by the disclosure. As such, some of these features may be mutually contradictory, in that they cannot be simultaneously present in a single embodiment. Similarly, some features are applicable to one aspect of the present subject matter, and inapplicable to others. In addition, the disclosure includes other present subject matters not presently claimed. Applicant reserves all rights in those presently unclaimed present subject matters including the right to claim such present subject matters, file additional applications, continuations, continuations in part, divisions, and/or the like thereof. As such, it should be understood that advantages, embodiments, examples, functional, features, logical, operational, organizational, structural, topological, and/or other aspects of the disclosure are not to be considered limitations on the disclosure as defined by the claims or limitations on equivalents to the claims. It is to be understood that, depending on the particular needs and/or characteristics of a SSC system individual and/or enterprise user, database configuration and/or relational model, data type, data transmission and/or network framework, syntax structure, and/or the like, various embodiments of the SSC system, may be implemented that enable a great deal of flexibility and customization. For example, aspects of the SSC system may be adapted for scoring executions in alternate trading systems. While various embodiments and discussions of the SSC system may have included reference to information security, it is to be understood that the embodiments described herein may be readily configured and/or customized for a wide variety of other applications and/or implementations.

What is claimed is:

1. A processor-implemented method for sound characterization, the method comprising:

deriving, via a processor, time-frequency transform of each of a plurality of sound signals from one or more sources, wherein the sound signals are detected by a plurality of sensing devices;

detecting via the processor, one or more single-source time-frequency analysis zones based at least on a correlation between the time-frequency transform signals from a pair of sensing devices;

estimating, via the processor, at least one direction of arrival for each source in the detected single source analysis zones;

creating, via the processor, a histogram of the estimated directions of arrival; and generating, via the processor, an estimate of a number of the sound sources and corresponding directions of arrival based at least on the histogram.

2. The method of claim 1 further comprising clustering directions of arrival; and determining a density function for the clustered direction of arrival.

3. The method of claim 1, wherein creating the histogram further includes creating a smoothed histogram by applying an averaging filter with a rectangular window.

4. The method of claim 1, wherein estimating the number of sound sources includes applying matching pursuit analysis to the histogram.

5. The method of claim 1, wherein estimating the number of sound sources includes applying peak search analysis to the histogram.

6. The method of claim 1, wherein estimating the number of sound sources includes applying linear predictive coding analysis to the histogram.

7. The method of claim 1, wherein estimating the direction of arrival comprises applying a Parzen windows analysis to the histogram.

8. The method of claim 1, wherein estimating the direction of arrival comprises applying a matching pursuit analysis to the histogram.

9. The method of claim 1, wherein detecting the single-source time-frequency analysis zones includes deriving a correlation coefficient based at least on the correlation between moduli of the time-frequency transform signals.

10. The method of claim 9, wherein detecting further comprises comparing the correlation coefficient to a confidence threshold.

11. The method of claim 3, wherein generating the estimate of the number of sources comprises modeling at least one source atom with one of a predetermined width and an adaptive width; and correlating the source atom to the smoothed histogram.

12. The method of claim 1, wherein generating the estimate of the number of sources further comprises computing a contribution of the sound source based at least on the correlation; and removing the contribution until a predetermined number of sound sources have been identified.

13. A system for sound source characterization, the system comprising:

a processor;

a memory coupled to the processor, the memory comprising:

a TF transform module configured to provide time-frequency analysis zones in response to a plurality of sound signals received from a plurality of sensing devices coupled to one or more sources;

a single-source analysis zone detector (SSAZ) detector configured to detect one or more single-source time-frequency analysis zones; and a DOA estimator and source counter configured to jointly estimate at least one direction of arrival for each source from the detected single-source time-frequency analysis zones and a number of the sound sources based at least on a histogram of DOA estimates.

14. The system of claim 13, wherein the DOA estimator and source counter is further configured to generate DOA estimates based at least on a cross-power spectrum derived over a plurality of pairs of sensing devices.

15. The system of claim 13, wherein the DOA estimator and source counter estimates DOAs based at least on a predetermined number of frequency components.

16. The system of claim 13, wherein the DOA estimator and source counter is further configured to generate the estimate of the number of sources by modeling at least one source atom with one of a predetermined width and an adaptive width; and by correlating the source atom to the histogram.

17. The system of claim 13, wherein estimating the directions of arrival of sound sources includes applying matching pursuit analysis to the histogram.

18. A computer-readable, non-transitory medium having embodied thereon a computer program for executing a method for sound characterization, the method comprising:

deriving, via a processor, time-frequency transform of each of a plurality of sound signals from one or more sources, wherein the sound signals are detected by a plurality of sensing devices;

detecting via the processor, one or more single-source time-frequency analysis zones based at least on correlation between the time-frequency transform signals from a pair of sensing devices;

estimating, via the processor, at least one direction of arrival for each source in the detected single-source time-frequency analysis zones;

creating, via the processor, a histogram of the estimated directions of arrival; and generating, via the processor, an estimate of a number of the sound sources and corresponding directions of arrival based at least on the histogram.

19. The method of claim 18, wherein estimating the number of sound sources includes applying matching pursuit analysis to the histogram.

20. The method of claim 18, wherein estimating the direction of arrival is based at least on a predetermined number of frequency components.

21. The method of claim 18, wherein estimating the number of sound sources further comprises generating a direction of arrival corresponding to each of the estimated sound sources.

* * * * *